US005815181A

United States Patent [19]

Kashino et al.

[11] Patent Number: 5,815,181

[45] Date of Patent: Sep. 29, 1998

[54] MICROMACHINE, LIQUID JET RECORDING HEAD USING SUCH MICROMACHINE, AND LIQUID JET RECORDING APPARATUS HAVING SUCH LIQUID JET RECORDING HEADMOUNTED THEREON

[75] Inventors: Toshio Kashino, Chigasaki; Hiroshi Sugitani, Machida; Masaaki Okada, Sanjo; Kiyomitsu Kudo, Yokohama, all of Japan

[73] Assignee: Canon Kabushiki Kaisha, Tokyo, Japan

[21] Appl. No.: 671,369

[22] Filed: Jun. 27, 1996

[30] Foreign Application Priority Data

| | | | |
|---|---|---|---|
| Jun. 28, 1995 | [JP] | Japan | 7-184760 |
| Dec. 18, 1995 | [JP] | Japan | 7-348304 |
| Dec. 26, 1995 | [JP] | Japan | 7-351416 |

[51] Int. Cl.[6] ..... B41J 2/05; B41J 2/19

[52] U.S. Cl. ..... 347/65; 347/67; 347/92; 417/207; 415/203

[58] Field of Search ..... 347/65, 63, 56, 347/54, 20, 1, 84, 92, 48, 67; 417/207, 208, 209; 165/87, 85; 415/203, 276–178

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/56 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 5,296,775 | 3/1994 | Cronin et al. | 310/309 |

FOREIGN PATENT DOCUMENTS

| | | |
|---|---|---|
| 59-123670 | 7/1984 | Japan . |
| 59-138461 | 8/1984 | Japan . |

*Primary Examiner*—Benjamin R. Fuller
*Assistant Examiner*—Juanita Stephens
*Attorney, Agent, or Firm*—Fitzpatrick, Cella, Harper & Scinto

[57] ABSTRACT

A micromachine comprises at least one heat generating unit arranged on the surface of a substrate, a housing for retaining liquid having a liquid retaining portion along the heat generating unit, and a rotator rotatively supported in the liquid retaining portion of the housing for retaining liquid. This rotator is structured to rotate by way of the boiling of liquid in the liquid retaining portion by heat generated by the heat generating unit. The micromachine, such a micropump or a micromotor, is incorporated in a liquid jet recording head to cause recording liquid to flow compulsorily in order to remove accumulated bubbles in the liquid paths for maintaining good performance of the liquid jet recording head at all times.

13 Claims, 19 Drawing Sheets

MICROMACHINE, LIQUID JET RECORDING HEAD USING SUCH MICROMACHINE, AND LIQUID JET RECORDING APPARATUS HAVING SUCH LIQUID JET RECORDING HEADMOUNTED THEREON

BACKGROUND OF THE INVENTION

1. Field of the Invention

The present invention relates to a micromachine, such as a micropump and a micromotor, having a rotator whose outer diameter is several μm to several mm, a liquid jet recording head using such micromachine, and a liquid jet recording apparatus having such liquid jet recording head mounted on it.

2. Related Background Art

In general, a liquid jet recording apparatus called a bubble jet printer needs a maintenance for recovering the discharge performance by removing bubbles accumulated in nozzles during its printing operation by carrying out a periodical suction that exerts negative pressure on the nozzles (liquid paths) of the liquid jet recording head.

Therefore, it is necessary to provide a pump to suck ink (recording liquid) from the common liquid chamber of the liquid jet recording head. Also, it is necessary to mount a tank and an ink absorbent or the like on the liquid jet recording head in order to prevent ink from flowing backward into the nozzles when the suction recovery is executed. As a result, a liquid jet recording head tends to be made larger in size, and higher in cost.

FIG. 26 is a partly broken perspective view which shows the principal part of a liquid jet recording head $E_o$ in accordance with one conventional example. This head comprises a heater board 1000 having heat generating units 1001*a* arranged on a straight line, lead electrodes 1001*b* connected therewith, and others; a resin layer 1010 laminated on the surface of the heater board; and a ceiling plate 1020 to cover the top of the resin layer 1010. The resin layer 1010 forms nozzles 1011 facing each of the heat generating units 1001*a* on the heater board 1000, respectively, and a common liquid chamber 1012 conductively connected with these nozzles. Also, to an aperture 1020*a* on the ceiling plate 1020, an ink supply tube 1021 is coupled for supplying ink to the common liquid chamber 1012.

When electric current is supplied to the heat generating units 1001*a* by means of a driving circuit (not shown) through the lead electrodes 1001*b*, ink in each of the nozzles 1011 is heated to create film boiling so as to transform ink into flying droplets, which are discharged from each of the nozzles 1011 for printing.

When a printing of the kind is repeated, bubbles are accumulated in the nozzles 1011. As a result, the interior of each nozzle 1011 is caused to present such a condition that the sufficient ink supply is no longer possible, and that some of the nozzles are disabled to discharge ink. This condition brings about defective prints in some cases.

Therefore, as described earlier, there is a need for such a maintenance as to exert negative pressure periodically on ink in the nozzles 1011 by means of suction in order to remove the accumulated bubbles. Here, it is generally practiced to provide a suction pump separately for operating this maintenance.

However, in accordance with the conventional technique described above, the pump, which is separately provided for exerting negative pressure in order to suck the nozzles of the liquid jet recording head, should be connected with the ink supply tube on the ceiling plate as required for carrying out such maintenance.

Therefore, while the apparatus is made more complicated, this operation invites increased running costs inevitably. In addition, it becomes necessary to mount an ink absorbent on the apparatus to dispose of the waste ink sucked by the application of negative pressure. This creates a problem that the size of an apparatus becomes larger after all.

Now, therefore, it is desired to develop a liquid jet recording head in which a small suction pump is incorporated. However, a diaphragmed or geared quantitative injection pump or a smaller minute quantitative pump of borrow type or tube type, which is currently available on the market, is 100 to 200 mm by its outer dimensions (length, width, and height) even for the pumps in smaller size. Also, an external power supply is needed as its power source. If these should be all mounted on a liquid jet recording head, it is inevitable that the liquid jet recording head becomes larger, and that its assembling process becomes extremely complicated.

In this respect, therefore, not only for the liquid jet recording head of a liquid jet recording apparatus, but also, for other OAT equipment, various kinds of medical equipment, biotechnological equipment, or the like, a micropump that can control a liquid amount of less than 1/100 gram unit, a micromotor that can drive ultra fine components assembled on a substrate, or some other micromachines have increasingly been in demand in recent years.

Meanwhile, the development of multiple nozzles has advanced to the stage where implementation of a higher printing is possible. As a result, the common liquid chamber of the liquid jet recording head has become larger. There is a tendency, therefore, that the amount of ink to be retained in the common liquid chamber increases accordingly. However, if the amount of ink in the common liquid chamber should increase, the temperature, viscosity, and other factors related to ink should become uneven, thus creating a problem that invites the degradation of printing quality inevitably, such as uneven density of prints.

SUMMARY OF THE INVENTION

The present invention is designed in consideration of these problems of the conventional technique described above. It is an objects of the invention to provide an extremely small micromachine whose components can be manufactured at low cost and easily assembled, and to provide a liquid jet recording head using such micromachine, and a liquid jet recording apparatus having such liquid jet recording head mounted on it.

It is another object of the invention to provide a liquid jet recording head comprising at least one heat generating unit arranged on the surface of a substrate; means for retaining liquid provided with a liquid retaining portion along each heat generating unit; and a rotator rotatively supported in the liquid retaining portion of means for retaining liquid, this rotator being structured to rotate by means of the boiling of liquid in the liquid retaining portion as heat is generated by each of the heat generating units.

It is still another object of the invention to provide a liquid jet recording head comprising a substrate having a plurality of heat generating units for use of droplet discharge; means for constituting liquid paths having a common liquid chamber conductively connected to the liquid paths along each of the heat generating units on the substrate; and at least one micropump for causing recording liquid in the common liquid chamber of means for constituting liquid paths to flow compulsorily. Here, the micropump is provided with a second heat generating unit arranged on a given location on the substrate, and a rotator capable of rotating by means of the boiling of recording liquid as heat is generated by the heat generating units.

The liquid in the liquid retaining portion is boiled by means of the heat generation of the heat generating units on the substrate. The bubbles thus created are received by the vanes or the like of the rotator to cause it to rotate. Hence, the liquid in the liquid retaining portion flows compulsorily when negative pressure is exerted by the rotation of the rotator. In this way, this structure is made to function as a micropump capable of agitating liquid in the liquid retaining portion, and also, to supply or exhaust the liquid to or from the liquid retaining portion.

The heat generating unit on the substrate is produced easily in the same manufacturing steps as those steps of producing the electrothermal transducing elements of a liquid jet recording head. Then, a rotator having spiral vanes attached thereto is just fitted on the liquid retaining portion of means for retaining liquid. Therefore, the assembling steps are extremely simple, and also, there is no fear that the apparatus should be made much larger as a whole.

Further, the rotator itself can be formed by an injection molding using plastic material. Here, by combining a laser processing with this, it is possible to manufacture an extremely small rotator at low costs.

With a micropump of the kind incorporated in a liquid jet recording head, it is possible to circulate recording liquid compulsorily, and to maintain a good discharge performance of recording liquid at all times.

If only the number of the vanes of the rotator and the number of the heat generating units are in the prime relationship without having any factors each other, the rotational torque is exerted more regularly on each of the vanes so as to stabilize the rotation of the rotator.

The liquid in the liquid retaining portion is boiled by means of the heat generation of the heat generating unit on the substrate. The bubbles thus created are received by the vanes of a first rotator to cause it to rotate, and then, a second rotator coaxially arranged therewith is driven to rotate. By the rotation of the second rotator, liquid on the circumference thereof is caused to flow compulsorily in order to supply, exhaust, and agitate such liquid.

BRIEF DESCRIPTION OF THE DRAWINGS

FIG. 5A is the plan view thereof, and FIG. 5B is the elevation thereof.

FIG. 12A is the plan view thereof and FIG. 12B is the elevation thereof.

DETAILED DESCRIPTION OF THE PREFERRED EMBODIMENTS

Hereinafter, with reference to the accompanying drawings, the description will be made of the embodiments in accordance with the present invention.

Figure 1:
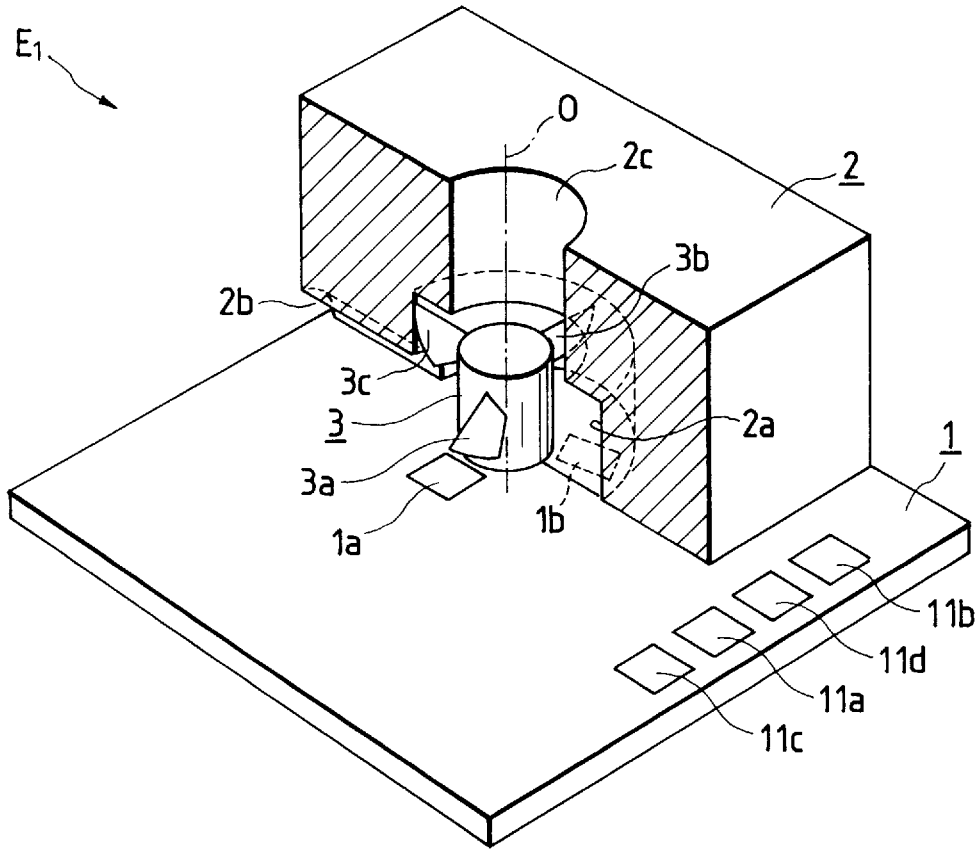
FIG. 1 is a partly broken perspective view which shows a micropump in a partly broken state in accordance with one embodiment of the present invention.

FIG. 1 is a perspective view showing a micropump $E_1$ in a partly broken state in accordance with a first embodiment of the present invention. The micropump $E_1$ comprises a substrate 1 having three heat generating units 1*a* to 1*c* (the heat generating unit 1*c* being shown in FIGS. 3 and 4) arranged at equal intervals around a given axis 0; a ceiling plate 2 bonded on the surface thereof, serving as means for retaining liquid; and a rotator rotatively fitted into a cylindrical pump chamber 2*a,* serving as a liquid retaining portion formed on the bottom of the ceiling plate 2. The ceiling plate 2 is shown in a state that almost a half thereof is broken away.

At the bottom of the ceiling plate 2, a suction port 2*b* is arranged to be conductively connected with the pump chamber 2*a*. Also, the upper end of the pump chamber 2*a* is open to an exhaust outlet 2*c* that penetrates the ceiling plate 2 upwardly in FIG. 1. When the rotator 3 rotates counterclockwise, liquid is sucked in through the suction port 2*b* and exhausted through the exhaust outlet 2*c*.

Each of the heat generating units 1*a* to 1*c* on the substrate 1 is connected to each of the separated terminals 11*a* to 11*c,* and a common terminal 11*d,* which are exposed on the edge of the substrate 1. Through these terminals, the heat generating units are energized one after another or at the same time at a given time in order to heat the liquid in the pump chamber 2*a* and boil it.

The rotator 3 is provided with three vanes 3*a* to 3*c,* that is, the same number of the heat generating units 1*a* to 1*c* on the substrate 1. These vanes receive the expansive power of bubbles created by heat generated by each of the heat generating units 1*a* to 1*c,* and cause the rotator 3 to rotate.

Figure 2:
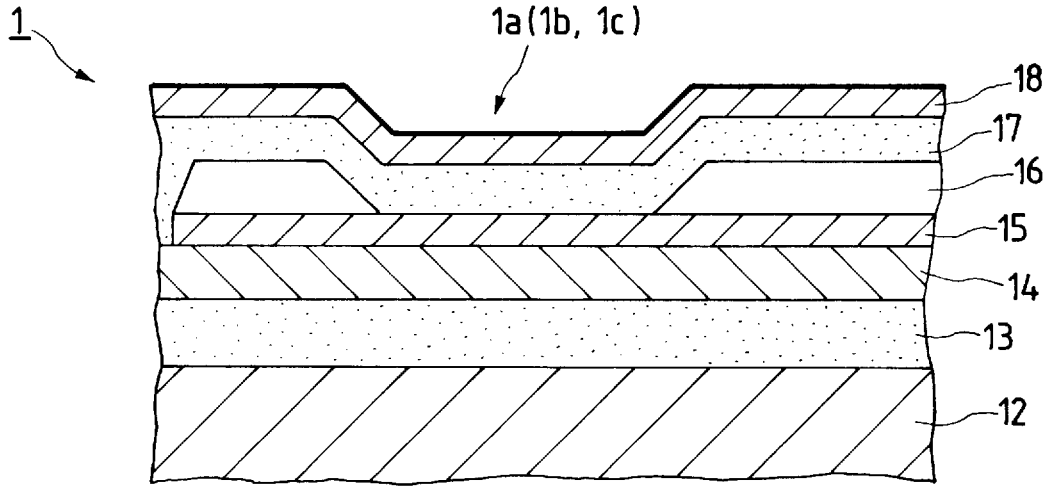
FIG. 2 is a cross-sectional view which schematically shows the inner structure of a substrate in accordance with one embodiment of the present invention.

The micropump of the present embodiment is to compulsorily circulate or agitate ink serving as recording liquid for the liquid jet recording head. As shown in FIG. 2, the inner structure of the substrate 1 is provided with a main body 12 formed by silicon substrate, and $SiO_2$ layer 13 is formed for an amount approximately 1.2 $\mu$m by oxidizing the surface of the silicon substrate. Then, as an interlayer insulating film, $SiO_2$ film 14 of a film thickness of approximately 1.2 $\mu$m is formed by means of PE-CVD or the like on the surface of the oxidized layer. Subsequently, a heat generating resistive element 15 formed by a tantalum nitride film of a film thickness of 100 Å is laminated by means of reactive sputtering, and further, an Al wiring layer 16 of a film thickness of 5500 Å is laminated also by means of sputtering for patterning. In this way, the heat generating units 1*a* to 1*c* are arranged by each of the heat generating resistive elements 15 exposed from the interrupted portion of the Al wiring layer 16 thus patterned.

The surface where the Al wiring layer 16 and the heat generating resistive element 15 are exposed is covered by a protective layer formed by $SiN_4$ layer (silicon nitride layer) 17 of a film thickness of 1 $\mu$m produced by the PE-CVD method and Ta layer (tantalum layer) 18 of a film thickness of 2300 Å laminated thereon.

Figure 3:
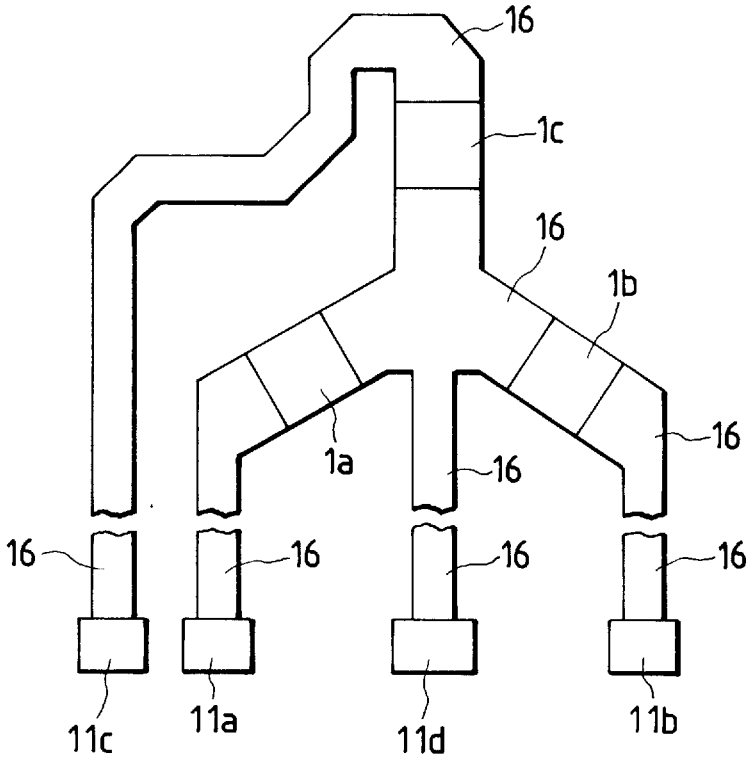
FIG. 3 is an upper surface view which shows a heat generating unit and the wiring connected therewith in accordance with one embodiment of the present invention.

The separated terminals 11*a* to 11*c* and common terminal 11*d* of each of the heat generating units 1*a* to 1*c* are arranged on the end portion of the patterned Al as shown in FIG. 3, and exposed from through holes provided for the protective layer.

Here, in accordance with the present embodiment, the silicon substrate is used as the main body of the substrate 1, but it may be possible to use a glass plate or a ceramic plate, such as $Al_2O_3$, instead of the silicon substrate.

Figure 4:
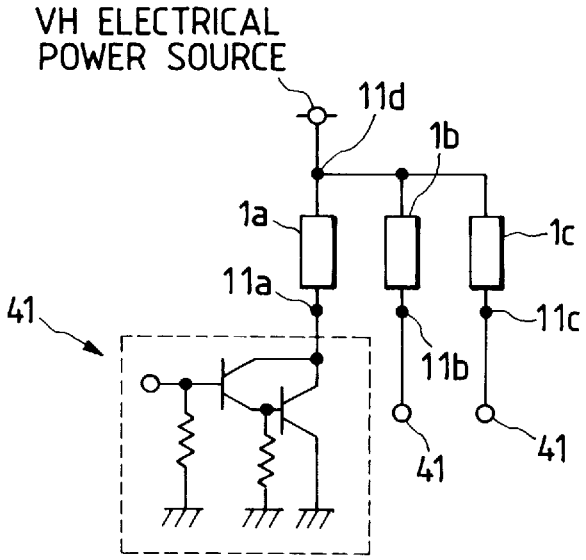
FIG. 4 is a circuit diagram which shows the electric circuit of the heat generating unit in accordance with one embodiment of the present invention.

The size of each of the heat generating units 1*a* to 1*c* is 60 $\mu$m wide and 300 $\mu$m long. The sheet resistance of the heat generation resistive element 15 is 21 Ω/□, and the resistive value is 105 Ω. Here, as shown in FIG. 4, the common terminal 11*d* is connected to the power-supply VH of an applied voltage of 30 V, and each of the separated terminals 11*a* to 11*c* is connected to a transistor 41 having an ON time of 20 $\mu$sec, respectively. Then, it is possible to obtain a sufficient energy to cause liquid (ink) in the pump chamber 2*a* to be foamed.

Figure 5A:
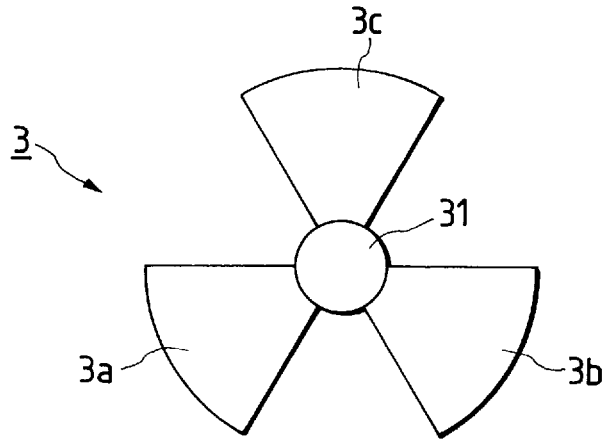
FIGS. 5A and 5B show the rotators of an apparatus in accordance with one embodiment of the present invention.

Each of the vanes 3*a* to 3*c* of the rotator 3 is arranged around the shaft 31 at equal intervals as shown in FIG. 5A in a configuration that each of the extremely thin plates is spirally affixed around the shaft 31 and formed integrally with the shaft 31. With this arrangement, the expansive power of the bubbles, which are created by the boiling of liquid in each of the heat generating units 1*a* to 1*c* on the substrate 1, can be easily transformed into the rotational force of the rotator 3.

It is preferable to use a plastic material having a small specific gravity, such as polypropylene, polyethylene, polysulfone, or polyethersulfone, which is easily usable for an integrated formation by an injection molding or the like.

Figure 5B:
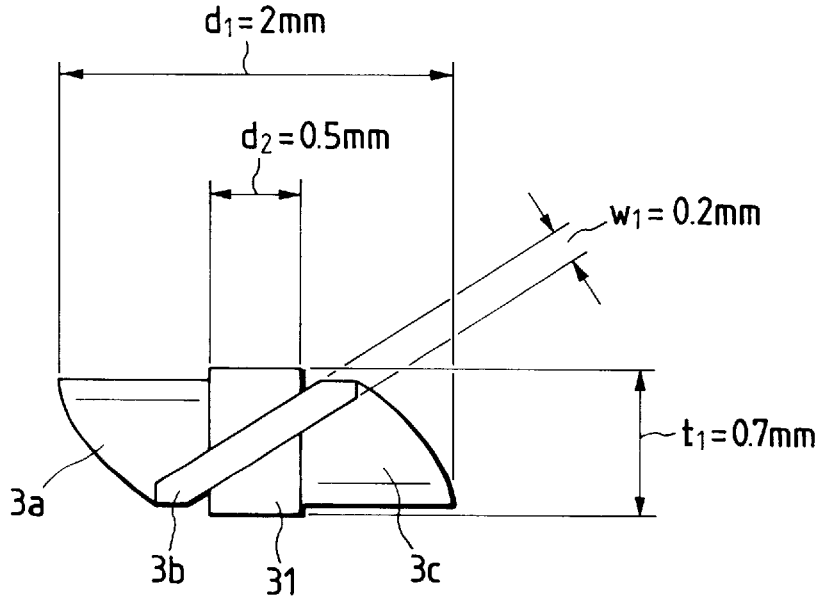

The dimension of the rotator 3 is as shown in FIG. 5B, for example. The maximum outer diameter thereof is set at 2 mm; the diameter $d_2$ of the shaft 31 is 0.5 mm; the thickness $w_1$ of each of the vanes 3*a* to 3*c* is 0.2 mm; and the length $t_1$ of the shaft 31 is 0.7 mm.

The micropump $E_1$ is assembled by positioning the ceiling plate 2 with respect to the heat generating units 1*a* to 1*c* after the rotator 3 is fitted into the pump chamber 2*a* of the ceiling plate 2, and then, the ceiling plate is adhesively bonded to the surface of the substrate 1.

The bonding agent used in this case should have a sufficient anticorrosion property against ink, and further, it should be capable of providing airtightness between the ceiling plate 2 and the substrate 1 to avoid any ink leakage therefrom. For example, a silicone sealant, TSE (manufactured by Toshiba Silicone), an epoxy adhesive agent, HP2R-HP2H (manufactured by Canon Chemical), or various urethane adhesive agents should be preferably applicable in this respect.

Also, the ceiling plate 2 is preferably formed by an injection molding using the same plastic material of the rotator or by a glass plate processed by etching.

Figure 6A:
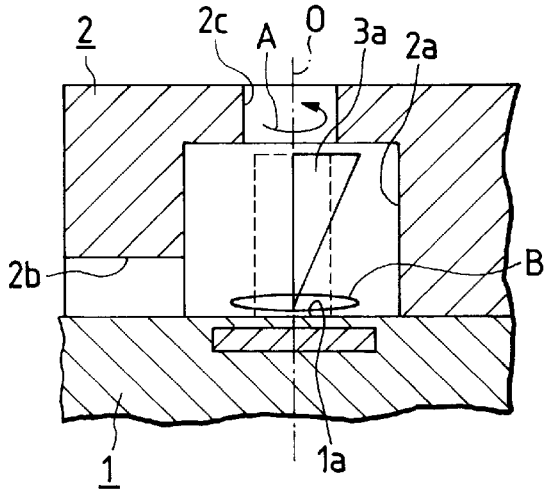
FIGS. 6A to 6D are cross-sectional views which illustrate the principle of rotation with respect to the rotator of an apparatus in accordance with one embodiment of the present invention.
Figure 6C:
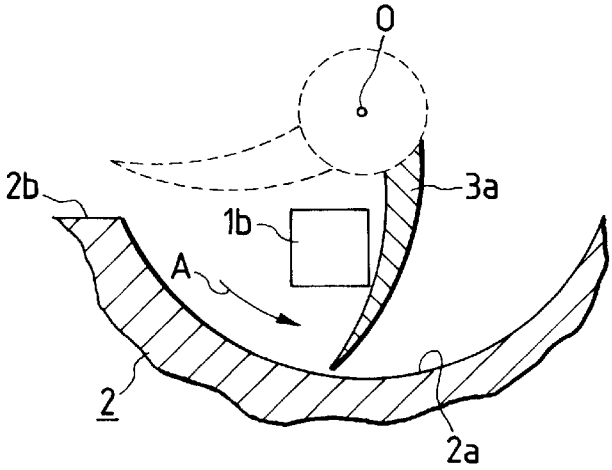
Figure 6B:
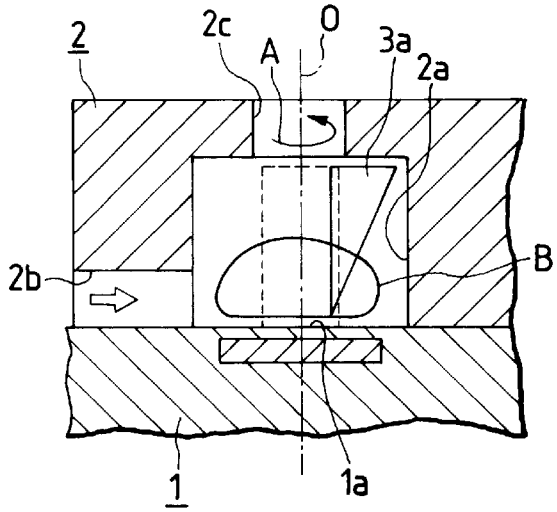
Figure 6D:
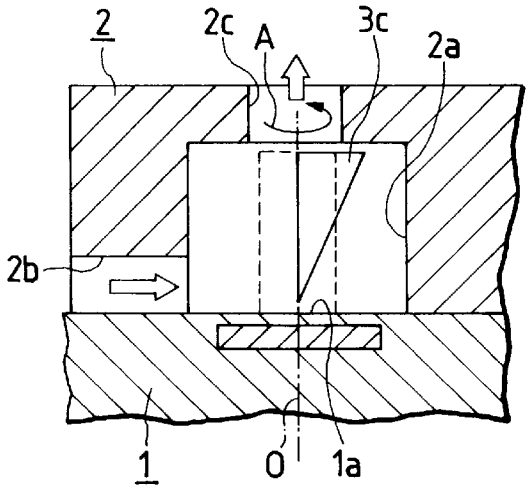

FIGS. 6A to 6D are views illustrating the process in which the first vane 3*a* of the rotator 3 causes the rotator 3 to rotate by receiving the expansive power of bubbles created in the first heat generating unit 1*a* on the substrate 1 in order to suck liquid (ink) from the suction port 2*b*. As shown in FIG. 6A, when liquid on the first heat generating unit 1*a* on the substrate 1 is heated by this unit, a bubble B is created. This bubble is gradually expanded as shown in FIG. 6B. The pressure thus exerted acts on the first vane 3*a* to enable the rotator 3 to rotate in the direction indicated by an arrow A. As shown in FIG. 6C, when the first vane 3*a* shifts on the second heat generating unit 1*b,* the bubble B is eliminated, thus creating a state where the pressure is reduced. As a result, a depressurized portion is generated on the second heat generating unit 1*b,* thus sucking liquid on the circumference thereof. At this juncture, on the first and third heat generating units 1*a* and 1*c,* the same state of depressurization takes place, and as shown in FIG. 6D, new liquid is sucked into the pump chamber 2*a* through the suction port 2*b* to exhaust liquid from the exhaust outlet 2*c.*

If, for example, a liquid is an ink whose main component is water and viscosity is approximately 4 to 5 cp, it is possible to pump up approximately 0.1 to 5 cc/min. by use of such pump.

In this respect, if the direction of each of the vanes 3*a* to 3*c* being wound around the shaft 31 of the rotator 3 is opposite, the rotational direction of the rotator 3 is in the direction opposite to the one indicated by the arrow A. Liquid is sucked in from the exhaust outlet 2*c* on the ceiling plate 2 and exhausted from the suction port 2*b.*

In accordance with the present embodiment, just an extremely small rotator is fitted into the pump chamber arranged on the ceiling plate. Therefore, the assembling of the micropump is extremely simple.

Also, the foaming of liquid is used as a driving source. Therefore, rising and falling of the pumping action are extremely rapid to make it preferably useable for pumping liquid intermittently at specific intervals or for agitating it.

Moreover, since the pumping action is stabilized, it is possible to pump up a specific quantity at a constant flow rate.

In addition, it is easy to manufacture the rotator itself, while no expensive material is needed. As a result, the costs of components are low, hence making it possible to materialize the provision of inexpensive micromachines.

Figure 7:
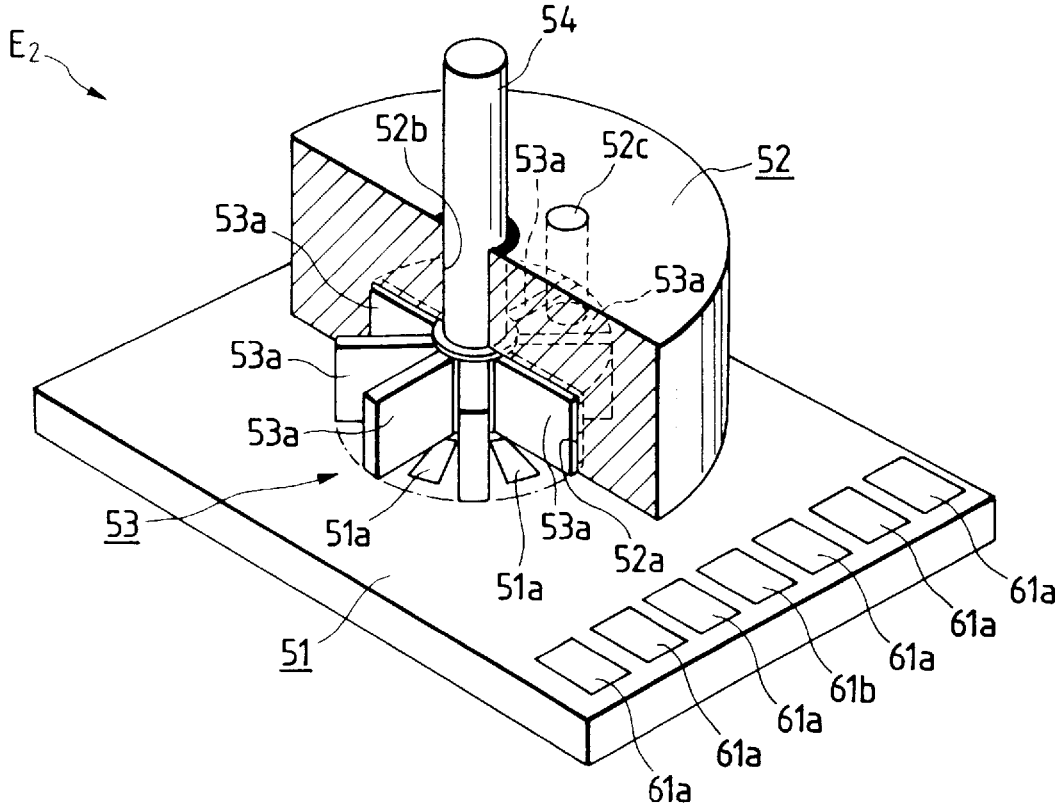
FIG. 7 is a partly broken perspective view which shows a micromotor in a partly broken state in accordance with another embodiment of the present invention.

FIG. 7 is a perspective view showing a micromotor $E_2$ in a partly broken state in accordance with a second embodiment of the present invention.

The micromotor $E_2$ comprises a substrate 51 having a plurality of heat generating units 51*a* arranged around a given axis at equal intervals; a ceiling plate 52 bonded on the surface thereof to serve as means for retaining liquid; and a rotor 53, which is a rotator rotatively fitted into a cylindrical rotor chamber 52 formed at the bottom of the ceiling plate 52 serving as liquid retaining portion. The ceiling plate 52 is shown in a partly broken state.

The rotor 53 comprises a spindle 54, which is a shaft member penetrating the through hole 52*b* of the ceiling plate 52, and a plurality of flat vanes 53*a* extended in the axial direction, which are arranged around the shaft member at equal intervals. The rotor is formed by the same material used for the rotator 3 of the first embodiment.

A method for manufacturing the rotor 53 may be to finish it in the final configuration by an injection molding as in the case of the rotator 3 of the first embodiment. However, since the vanes 53*a* are flat and extended in the axial direction, it is possible to produce a blank at first in such a configuration that an annular member having the same outer diameter as the vanes 53*a* is integrally formed with a spindle 54 by means of an injection molding, and then, to cut out each of the vanes 53*a* by a laser processing by the application of excimer laser or the like. In this case, for the material of the rotor, it is preferable to use polysulfone or polyethersulfone having absorption area in the vicinity of the wavelength of 248 nm of the excimer laser.

To describe one specific example, a blank having an annular member of 5 mm diameter and 0.5 mm thick, and a spindle of 0.5 mm diameter is formed by an injection molding, and then, a rotor having the vanes whose outer diameter is 1.5 mm is manufactured by the application of a batch exposure by use of an excimer laser oscillator, a light source combined with an optical system that enhances the power concentration, and a stainless steel mask.

As described above, it is possible to manufacture extremely small rotors in high precision at low costs by combining the injection molding and laser processing.

The substrate 51 is provided with a common terminal 61*b* and separated terminals 61*a* to energize each of the heat generating units 51*a.* The inner structure of the substrate 51 is the same as the substrate 1 of the first embodiment.

The micromotor $E_2$ is assembled as given below. At first, the spindle 54 of the rotor 53 is put to penetrate the through hole 52*b* of the ceiling plate 52 so as to fit the vanes 53*a* into the rotor chamber 52*a.* Then, the ceiling plate 52 is positioned at a given location on the substrate 51 to bond them together as in the first embodiment. Subsequently, a lubricant, such as grease, that dually serves as a sealant, is injected between the through hole 52*b* of the ceiling plate 52 and the spindle 54 of the rotor 53. Liquid is filled in from the liquid supply port 52*c* provided for the ceiling plate 52 to the rotor chamber 52*a,* and then, the liquid supply port 52*c* is sealed.

Each of the heat generating units 51 is energized at one time or one after another, thus causing the liquid, which is in contact with each one of them, to be foamed. Then, as in the first embodiment, by the application of the pressure exerted by expanded bubbles, the rotor 53 rotates to drive the spindle 54 to rotate. In this way, a rotating element (not shown) coupled to the spindle can rotate at a revolution of several tens of rpm to as high as several thousands of rpm.

A part of liquid in the rotor chamber 52*a* flows into the gap between the through hole 52*b* of the ceiling plate 52 and the spindle 54. As a result, the spindle 54 is axially supported by the static pressure thus exerted. Therefore, the spindle 54 can rotate in a high precision of less than 0.5 $\mu$m deflection.

Figure 8:
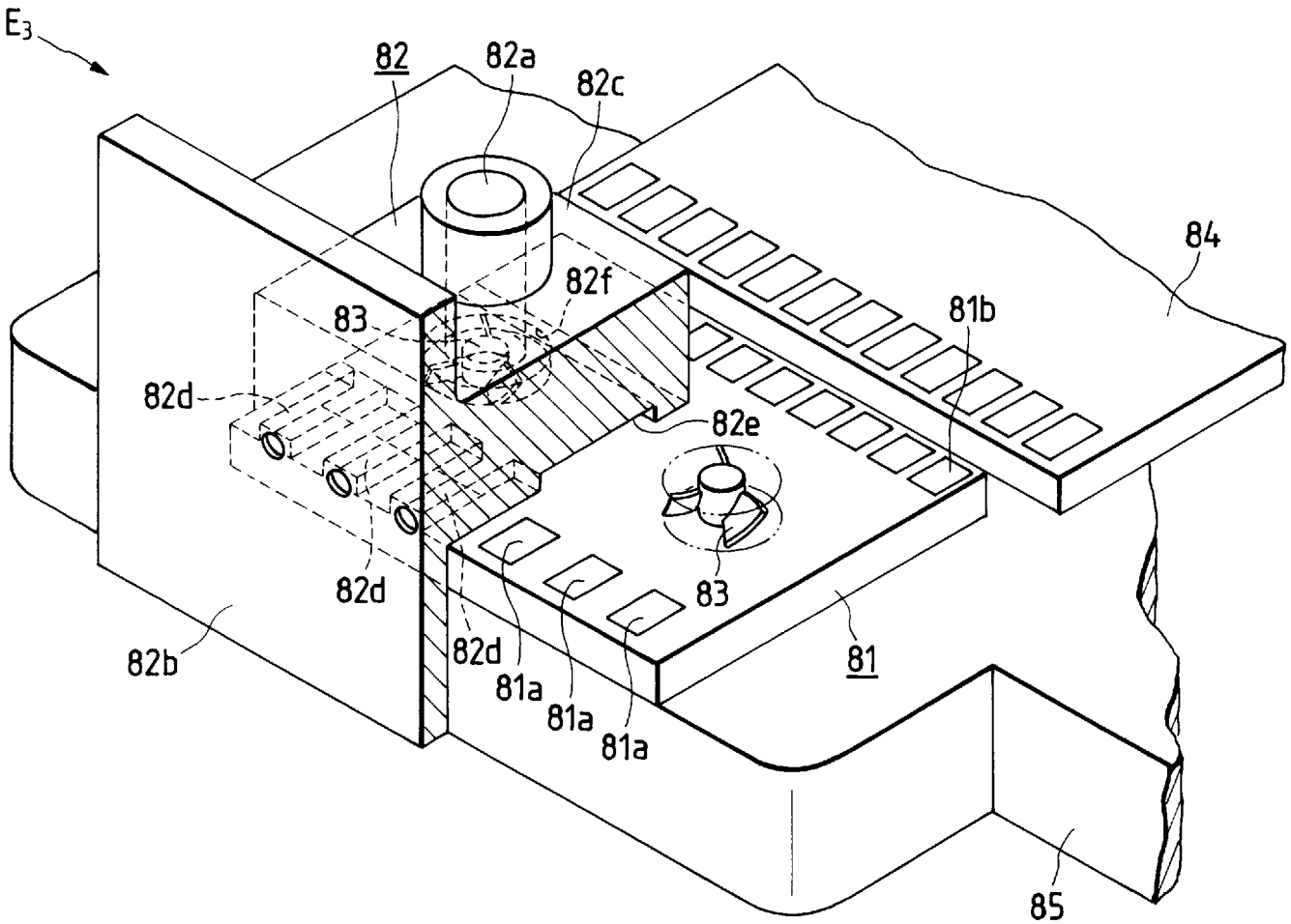
FIG. 8 is a partly broken perspective view showing the principal part of a liquid jet recording head in a partly broken state, which uses a micropump in accordance with one embodiment of the present invention.

FIG. 8 is a partly perspective view which shows the principal part of a liquid jet recording head $E_3$ using the same micropump as the first embodiment. This head comprises a substrate 81 whose interior is structured the same as that of the substrate 1 of the first embodiment; and a ceiling plate 82 serving as means for constituting liquid paths formed by plastic, which is pressed onto the surface of the substrate 81 by an elastic member to be described later. The substrate 81 is provided with the heat generating units 81*a* for use of droplet discharge, arranged on one line near one end thereof, and second heat generating units (not shown) arranged on the central part thereof for use of a pair of micropumps. On the other end of the substrate 81, separate terminals 81*b* and a common terminal (not shown) are exposed for use of energizing the heat generating units 81*a* to discharge droplets and drive micropumps at a given timing, respectively.

The ceiling plate 82 comprises a pair of tubular extrusions 82*a* (one of them is not shown) and an orifice plate member 82*b* having orifices arranged on one line thereon. On the main body 82*c* of the ceiling plate 82, there are formed liquid paths (nozzles) 82*d* conductively connected to each of the orifices on the orifice plate member 82*b,* and a pump chamber 82*f* conductively connected with a common liquid chamber 82*e,* and each of the extrusions 82*a.* The same rotator 83 as the rotator 3 of the first embodiment is fitted into each of the pump chambers 82*f* rotatively.

Each of the orifices 82*a* of the orifice plate member 82*b* of the ceiling plate 82 is arranged over approximately 4.5 mm at equal intervals in a high density of approximately 360 dpi (dots per inch).

The inner structure of the heat generating units 81*a* for use of droplet discharge and that of the heat generating units for use of micropumps on the substrate 81 are the same with the exception of the areas thereof. As a result, it is possible to produce them by one and the same process. In this respect, the dimension of each heat generating unit for use of micropumps is 105×40 $\mu m^2$, while the area of each heat generating unit 81*a* for use of droplet discharge is extremely fine so as to materialize such dot numbers as described above.

The ceiling plate 82 is integrally formed by an injection molding in the same way as the ceiling plate 1 for the first embodiment. Then, on the surface of the orifice plate member 82*b,* a water repellent film (Saitop CTX manufactured by Asahi Glass) is coated. If any improvement of adhesion is needed, it should be effective to coat an adhesion enhancement agent (Sealant coupling agent A1110 manufactured by Nihon Unika) before coating any water repellent agent.

Also, it is preferable to adopt a laser processing by the application of excimer laser or the like for drilling operation to provide the orifices on the orifice plate member 82*b* of the ceiling plate 82. For the manufacture of each of the rotators 83, an injection molding is adopted in the same way as the manufacture of the rotator 3 for the first embodiment. However, if the shape of the vanes is simplified, it may be possible to adopt a method wherein an injection molding and a laser processing are combined as in the second embodiment. Here, it is arranged that the directions in which the vanes are wound around a pair of rotators are opposite to each other, and one of them is structured to function as a micropump on the recording liquid supply side, and the other to function as a micropump on the recording liquid exhaust side.

In this respect, the substrate 81 is supported to a heat radiation plate 85 together with a printed circuit board 84 having a driving circuit (not shown) on it to drive the heat generating units 81*a* for use of droplet discharge and the heat generating units for use of micropumps at a given timing, respectively.

The recording liquid is sucked in to the common liquid chamber 82*e* by means of the micropump on the recording liquid supply side, and exhausted by the micropump on the recording liquid exhaust side.

The recording liquid that flows from the common liquid chamber 82*e* to each of the liquid paths 82*d* is heated by means of the heat generating units 81*a* for use of droplet discharge, which generate heat selectively by use of the driving circuit described above. The recording liquid is thus foamed and discharged from the orifices of the orifice plate unit 82*b* as flying droplets, which adhere to a recording sheet or the like (not shown) for printing.

The recording liquid in the common liquid chamber 82*e* is compulsorily circulated by means of both micromachines as described above. Therefore, the bubbles being accumulated by droplet discharges on each of the liquid paths and the common liquid chamber are continuously exhausted, thus making it possible to prevent the printing quality from being degraded due to the presence of such bubbles.

In addition, the recording liquid in the common liquid chamber is continuously agitated, thus making it possible to prevent the temperature of recording liquid from being changed, hence stabilizing the printing performance.

Further, it is possible to increase pressure exerted on the recording liquid in the common liquid chamber by temporarily suspending the micropump on the exhaust side or reducing the speed thereof so as to remove the adhesive particles in each of the liquid paths 82*d* by pushing out the recording liquid from each of the liquid paths 82*d* compulsorily. In this way, it is possible to implement the recovery of the droplet discharge performance. Conventionally, the recovery of the droplet discharge performance is carried out by a pump separately prepared. However, in accordance with the present embodiment, the micropump incorporated in the liquid jet recording head can be used for such purpose. Therefore, it is possible to simplify the assembling processes and the maintenance of a liquid jet recording apparatus significantly.

Figure 9:
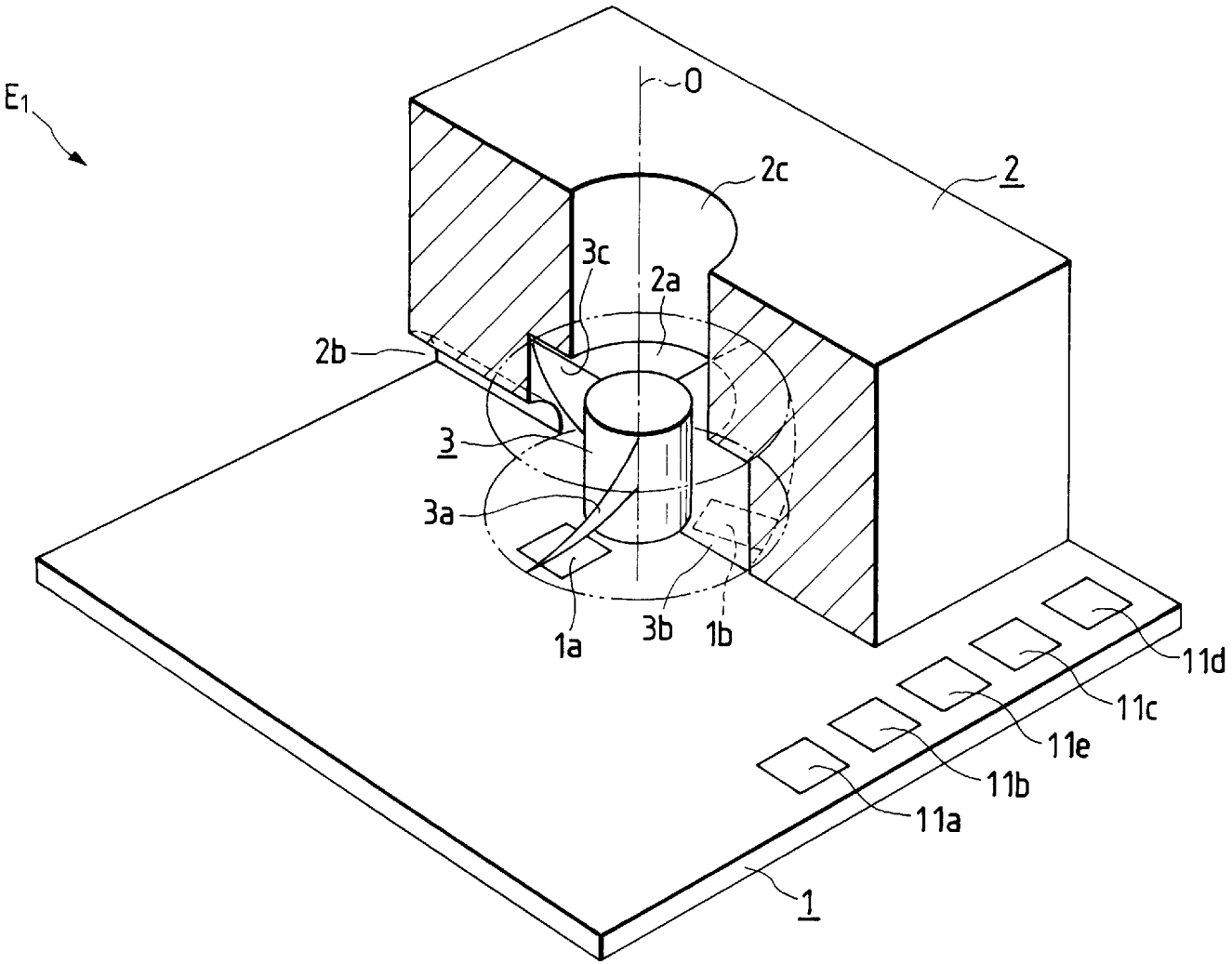
FIG. 9 is a partly broken perspective view which shows a micropump in a partly broken state in accordance with still another embodiment of the present invention.
Figure 10:
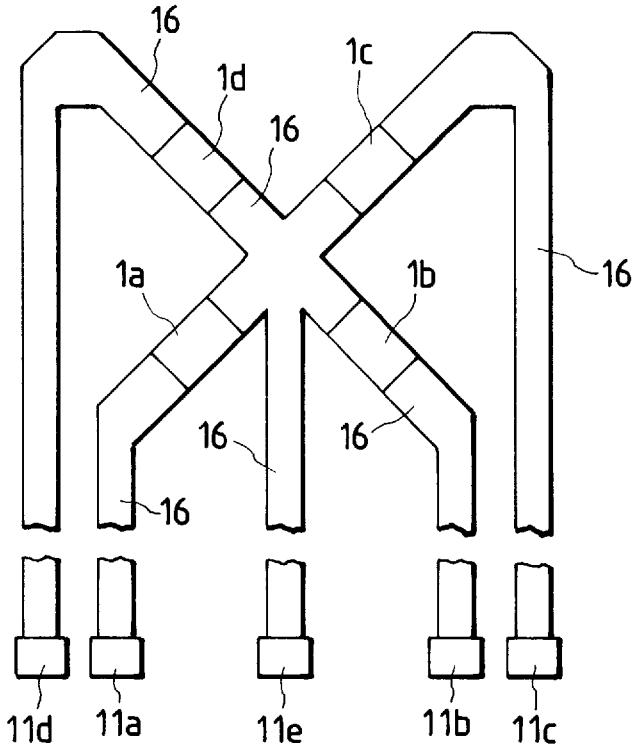
FIG. 10 is an upper surface view which shows the wiring connected with heat generating units in accordance with still another embodiment of the present invention.
Figure 11:
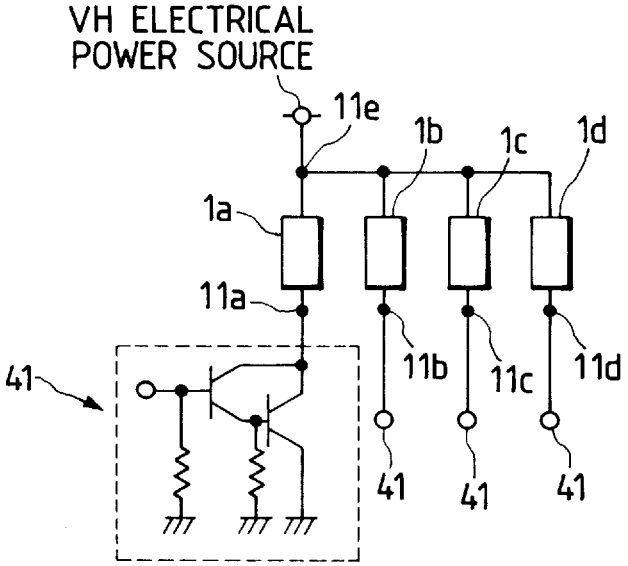
FIG. 11 is a circuit diagram which shows the electric circuit of the heat generating unit in accordance with still another embodiment of the present invention.

FIG. 9 is a partly broken perspective view which shows a micropump $E_1$ in accordance with a third embodiment of the present invention. The micropump $E_1$ comprises a substrate 1 having four heat generating units 1*a* to 1*d* (heat generating units 1*c* and 1*d* are shown in FIGS. 10 and 11) arranged at equal intervals around a given axis 0; a ceiling plate 2 bonded on the surface thereof serving as means for retaining liquid; and a rotator 3 fitted rotatively into a cylindrical pump chamber 2*a* formed at the bottom of the ceiling plate 2 to serve as liquid retaining portion. The ceiling plate is shown in a state where substantially a half of it is broken away.

At the bottom of the ceiling plate 2, a suction port 2*b* is provided to conductively connect it to the pump chamber 2*a*. Also, the upper end of the pump chamber 2*a* is open to the exhaust outlet 2*c* that penetrates the ceiling plate 2 upward in FIG. 9. When the rotator 3 rotates counterclockwise, liquid is sucked in from the suction port 2*b,* and exhausted from the exhaust outlet 2*c*.

Each of the heat generating units 1*a* to 1*d* on the substrate 1 is connected with each of the separated terminals 11*a* to 11*d* and a common terminal 11*e* exposed at the edge of the substrate 1. Through these terminals, the heat generating units are energized one after another or at one time at a given timing to heat liquid in the pump chamber 2*a,* thus causing it to be boiled.

The rotator 3 is provided with three vanes 3*a* to 3*c,* which receive bubbles created by means of heat generated by each of the heat generating units 1*a* to 1*d,* and transform such expansive pressure into rotational torque, thus causing the rotator 3 to rotate.

The micropump of the present embodiment is to compulsorily circulate or agitate ink, which is the recording liquid used by the liquid jet recording head. The inner structure of the substrate 1 is as already described in conjunction with FIG. 2.

Each of the separated terminals 11*a* to 11*d* and the common terminal 11*e* of the heat generating units 1*a* to 1*d* is arranged on the end portion of the Al wiring layer 16 patterned as shown in FIG. 10.

Here, in accordance with the present embodiment, the silicon substrate is used as the main body of the substrate 1, but it may be possible to use a glass plate or a ceramic plate, such as $Al_2O_3$, instead of the silicon substrate.

The size of each of the heat generating units 1*a* to 1*c* is 60 $\mu$m wide and 300$\mu$m long. The sheet resistance of the heat generative resistive element 15 is 21 Ω/□, and the resistive value is 105 Ω. Here, as shown in FIG. 11, the common terminal 11*d* is connected to the power-supply VH of an applied voltage 30 V, and each of the separated terminals 11*a* to 11*c* is connected to a transistor 41 having an ON time of 20 $\mu$sec, respectively. Then, it is possible to obtain a sufficient energy to cause liquid (ink) in the pump chamber 2*a* to be foamed.

Figure 12A:
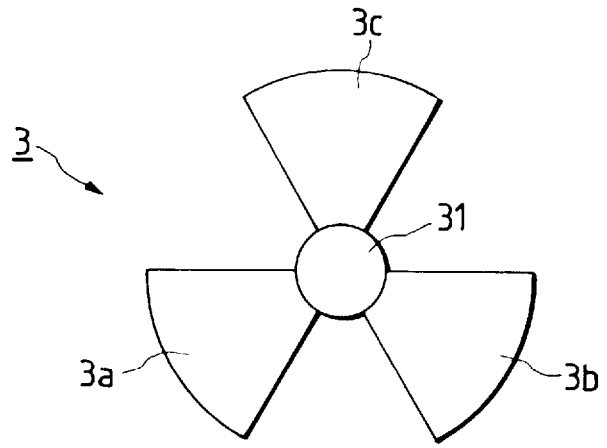
FIGS. 12A and 12B show the rotators of an apparatus in accordance with still another embodiment of the invention.

Each of the vanes 3*a* to 3*c* of the rotator 3 is arranged around the shaft 31 at equal intervals as shown in FIG. 12A in a configuration that each of the extremely thin plates is spirally affixed around the shaft 31 spirally and formed integrally with the shaft 31. With this arrangement, the expansive power of the bubbles, which are created by the boiling of liquid in each of the heat generating units 1*a* to 1*c* on the substrate 1, can be transformed easily into the rotational force of the rotator 3.

It is preferable to use a plastic material having a small specific gravity, such as polypropylene, polyethylene, polysulfone, or polyethersulfone, which is easily usable for an integrated formation by an injection molding or the like.

Figure 12B:
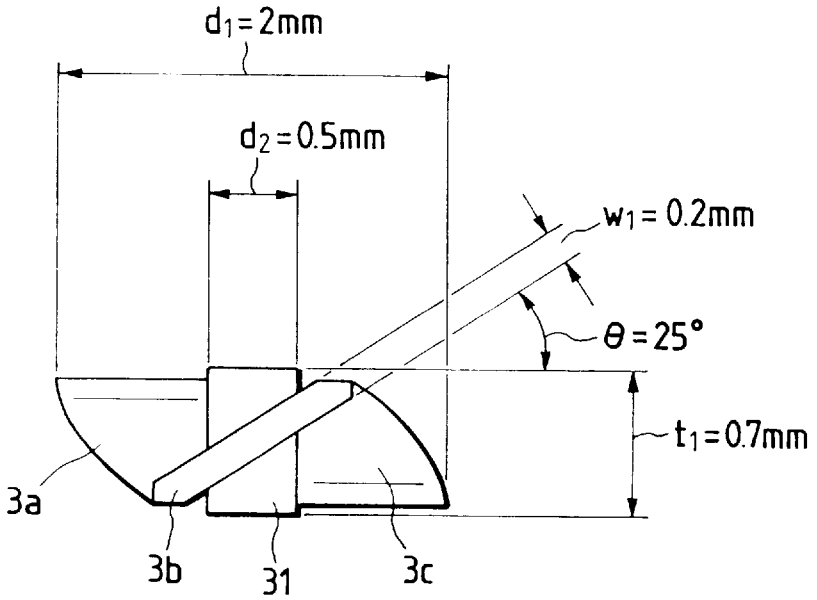

The dimension of the rotator 3 is as shown in FIG. 12B, for example. The maximum outer diameter thereof is set at 2 mm; the diameter $d_2$ of the shaft 31 is 0.5 mm; the thickness $w_1$ of each of the vanes 3*a* to 3*c* is 0.2 mm; the mounting angle θ is 25°; and the length $t_1$ of the shaft 31 is 0.7 mm.

The micropump $E_1$ is assembled by positioning the ceiling plate 2 to the heat generating units 1*a* to 1*c* after the rotator 3 is fitted into the pump chamber 2*a* of the ceiling plate 2, and then, the ceiling plate is adhesively bonded to the surface of the substrate 1.

The bonding agent used in this case should have a sufficient anticorrosion property against ink, and further, it should be capable of providing airtightness between the ceiling plate 2 and the substrate 1 to avoid any ink leakage therefrom. In this respect, a silicone sealant, TSE (manufactured by Toshiba Silicone), an epoxy adhesive agent, HP2R-HP2H (manufactured by Canon Chemical), or various urethane adhesive agents should be preferably applicable, for example.

Also, the ceiling plate 2 is preferably formed by an injection molding using the same plastic material of the rotator 3 or by a glass plate processed by etching.

Figure 13A:
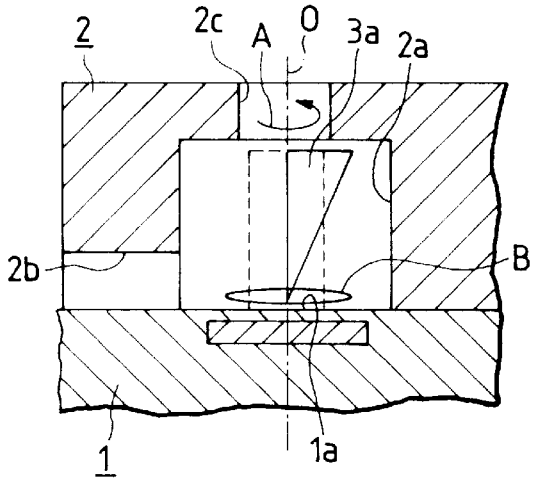
FIGS. 13A to 13D are cross-suctional views which illustrate the principle of rotation with respect to the rotator of an apparatus in accordance with still another embodiment of the present invention.
Figure 13C:
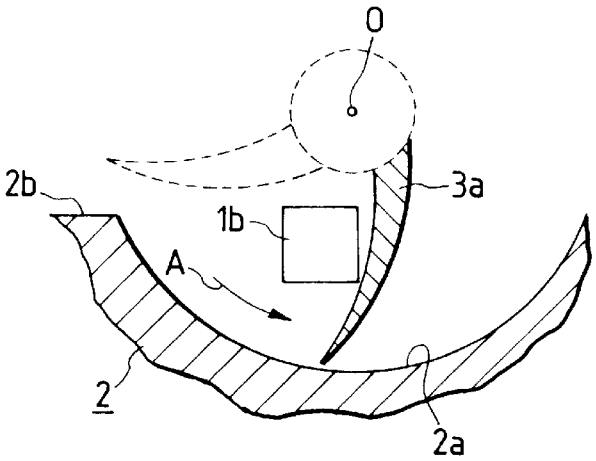
Figure 13B:
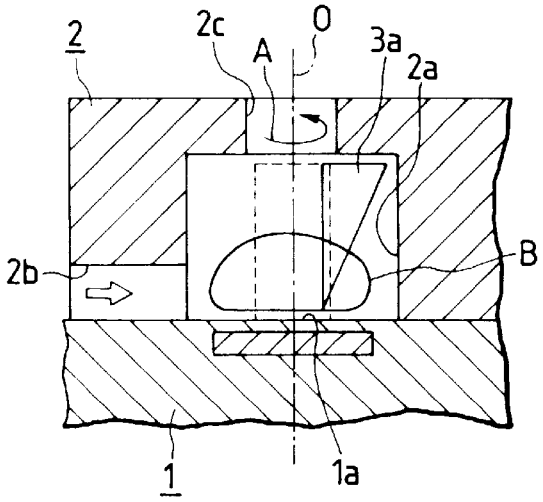
Figure 13D:
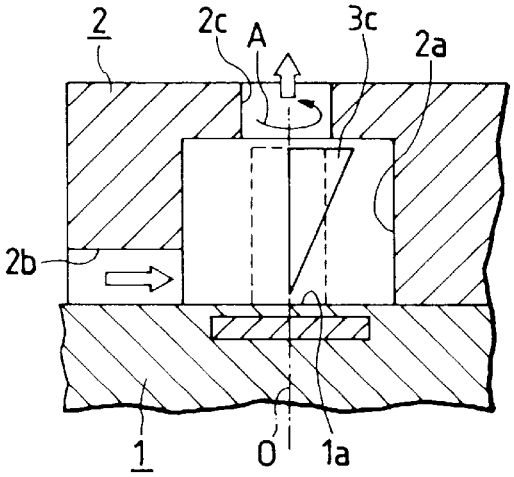

FIGS. 13A to 13D are views illustrating the process in which the first vane 3*a* of the rotator 3 causes the rotator 3 to rotate by receiving the expansive power of bubbles created in the first heat generating unit 1*a* on the substrate in order to suck liquid (ink) from the suction port 2*b*. As shown in FIG. 13A, when liquid on the first heat generating unit 1*a* on the substrate 1 is heated thereby, a bubble B is created. This bubble is gradually expanded as shown in FIG. 13B. The pressure thus exerted acts on the first vane 3*a* to enable the rotator 3 to rotate in the direction indicated by an arrow A . As shown in FIG. 13C, when the first vane 3*a* shifts on the second heat generating unit 1*b,* the bubble B is eliminated to create a state where the pressure is reduced. As a result, a depressurized portion is created on the second heat generating unit 1*b,* thus sucking liquid on the circumference thereof. At this juncture, on the first, third, and fourth heat generating units 1*a,* 1*c,* and 1*d,* the same state of depressurization takes place, and as shown in FIG. 13D, new liquid is sucked into the pump chamber 2*a* through the suction port 2*b,* and liquid is exhausted from the exhaust outlet 2*c.*

If, for example, a liquid is an ink whose main component is water and viscosity is approximately 4 to 5 cp, it is possible to pump up approximately 0.1 to 5 cc/min. by use of such pump.

In this respect, if the direction of each of the vanes 3*a* to 3*c* being wound around the shaft 31 of the rotator 3 is opposite, the rotational direction of the rotator 3 is in the direction opposite to the one indicated by the arrow A. Liquid is sucked in from the exhaust outlet 2*c* on the ceiling plate 2 and exhausted from the suction port 2*b*.

In accordance with the present embodiment, just an extremely small rotator is fitted into the pump chamber arranged on the ceiling plate. Therefore, the assembling of the micropump is extremely simple.

Also, the foaming of liquid is used as a driving source. Therefore, rising and falling of the pumping action are extremely rapid to make it preferably useable for pumping up liquid intermittently at specific intervals or for agitating it.

Moreover, since the pumping action is stabilized, it is possible to pump up a specific quantity at a constant flow rate. Particularly, since the number of heat generating units on the substrate is 4, while the number of the vanes of the rotator is 3, these are in a prime relationship where no factors exist between them. Therefore, it is possible to rotate the rotator stably at all times even if a slight irregularity is present in the heat generating amount (foaming energy) of each of the heat generating units. As described above, the variation of rotational torque can be prevented by defining the number of the heat generating units on the substrate and the number of the vanes of the rotator to present a prime relationship to each other, thus producing an excellent effect on the stabilization of the pumping action.

Moreover, since the mounting angle of each vane of the rotator is 25°, there is an advantage that the efficiency is extremely high in transforming the foaming energy into the rotational torque at each of the heat generating units. In general, it is desirable to set the mounting angle of the vanes at less than 30°, and if there is any restriction, such as space saving, for the design consideration, it is preferable to set such angle at less than 20°.

In addition, it is easy to manufacture the rotator itself, while no expensive material is needed. The costs of components are low accordingly. Therefore, it is possible to materialize the provision of extremely small and inexpensive micromachines.

Figure 14:
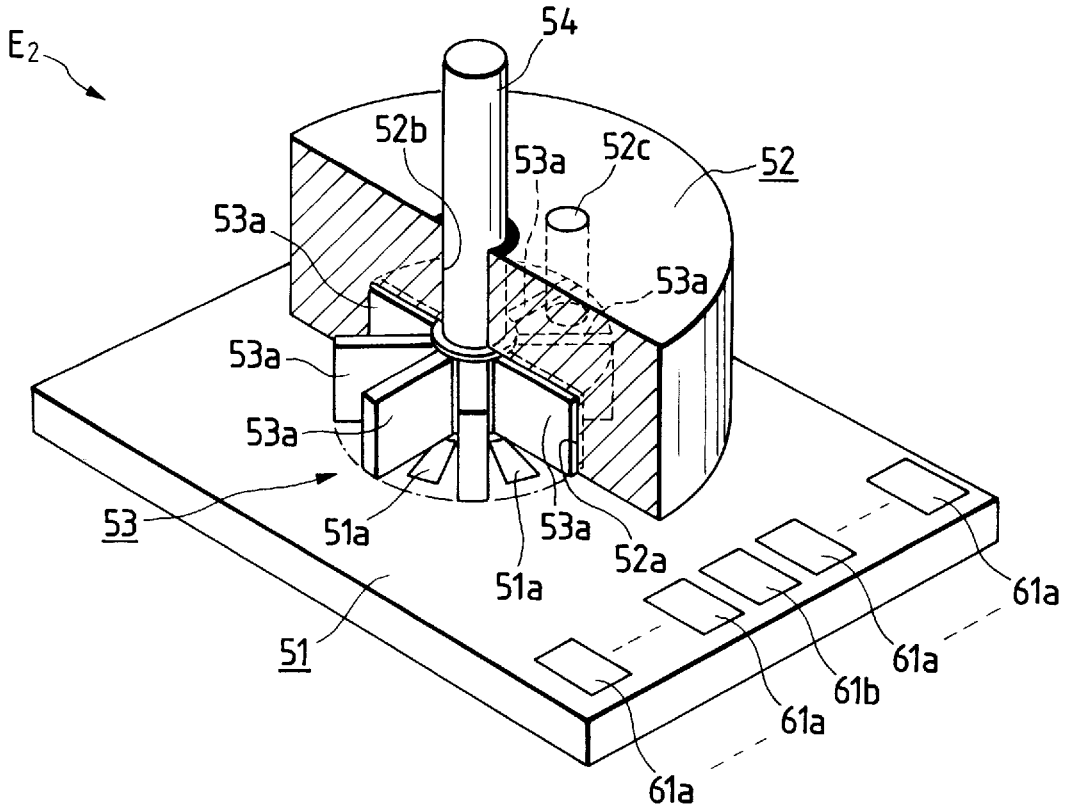
FIG. 14 is a partly broken perspective view which shows a micromotor in a partly broken state in accordance with still another embodiment of the present invention.
Figure 15:
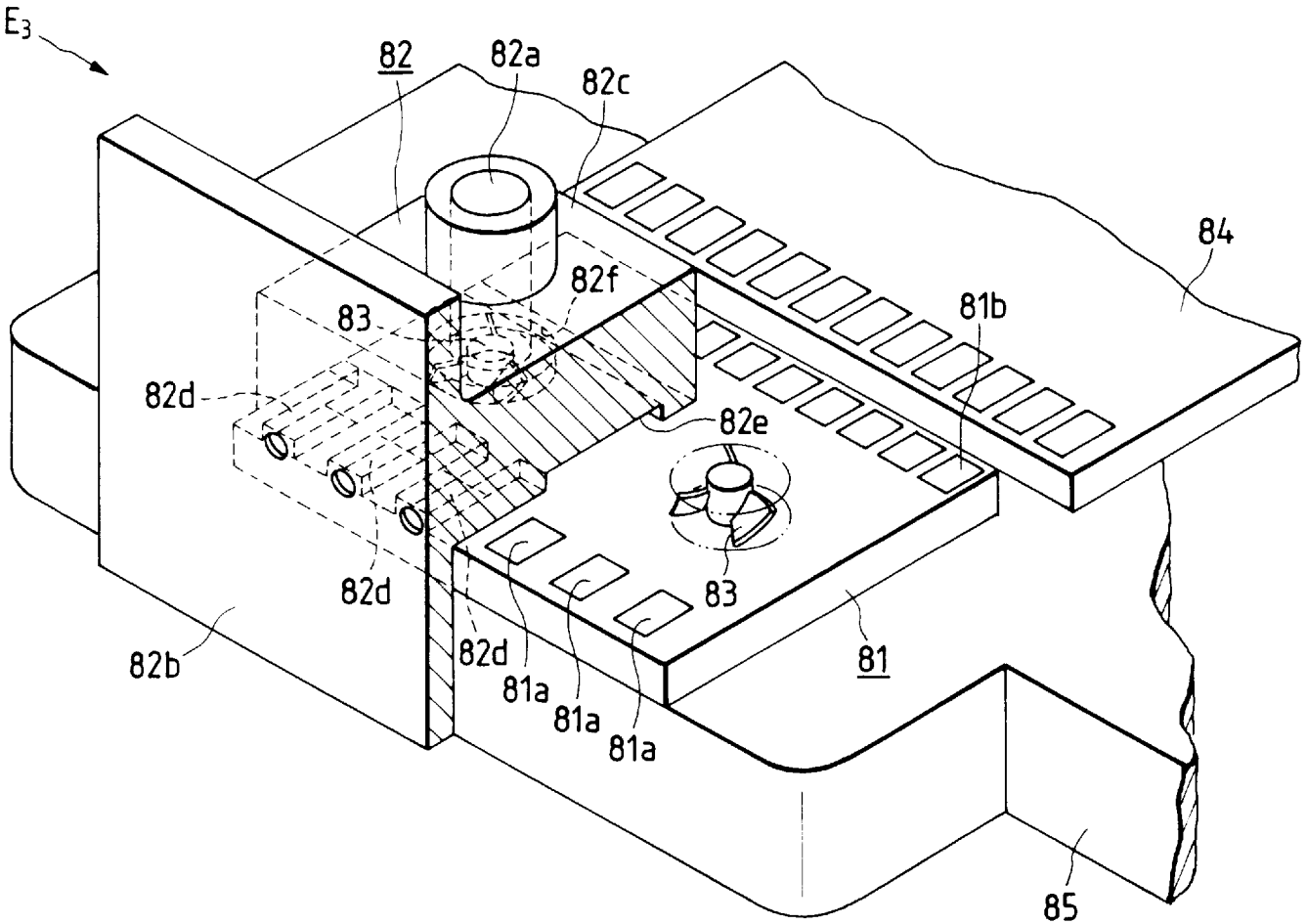
FIG. 15 is a partly broken perspective view which shows the principle part of the liquid jet recording head using a micropump in accordance with still another embodiment of the present invention.

FIG. 14 is a perspective view showing a micromotor $E_2$ in a partly broken state in accordance with a fourth embodiment of the present invention. The micromotor $E_2$ comprises a substrate 51 having a plurality of heat generating units 51*a* arranged around a given axis at equal intervals; a ceiling plate 52 bonded on the surface thereof to serve as means for retaining liquid; and a rotor 53, which is a rotator rotatively fitted into a cylindrical rotor chamber 52 formed at the bottom of the ceiling plate 52 serving as liquid retaining portion. The ceiling plate 52 is shown in a partly broken state.

The rotor 53 comprises a spindle 54, which is a shaft member penetrating the through hole 52*b* of the ceiling plate 52, and a plurality of flat vanes 53*a* extended in the axial direction, which are arranged around the shaft member at equal intervals. The rotor is formed by the same material used for the rotator 3 of the third embodiment. The number of the vanes 53*a* of the rotor 53 is defined to present a prime relationship with respect to the number of the heat generating units 51*a* on the substrate 51.

A method for manufacturing the rotor 53 may be to finish it in the final configuration by an injection molding as in the case of the rotator 3 of the third embodiment. However, since the vanes 53*a* are flat and extended in the axial direction, it is possible to produce a blank at first in such a configuration that an annular member having the same outer diameter as the vanes 53*a* is integrally formed with a spindle 54 by means of an injection molding, and then, to cut out each of the vanes 53*a* by a laser processing by the application of excimer laser or the like. In this case, for the material of the rotor, it is preferable to use polysulfone or polyethersulfone having absorption area in the vicinity of the wavelength of 248 nm of the excimer laser.

To describe one specific example, a blank having an annular member of 5 mm diameter and 0.5 mm thick, and a spindle of 0.5 mm diameter is formed by an injection molding, and then, a rotor having the vanes whose outer diameter is 1.5 mm is manufactured by the application of a batch exposure by use of an excimer laser oscillator, a light source combined with an optical system that enhances the power concentration, and a stainless steel mask.

As described above, it is possible to manufacture extremely small rotors in high precision at low costs by combining the injection molding and laser processing.

The substrate 51 is provided with a common terminal 61*b* and separated terminals 61*a* to energize each of the heat generating units 51*a*. The inner structure of the substrate is the same as the substrate 1 of the third embodiment.

The micromotor $E_2$ is assembled as given below. At first, the spindle 54 of the rotor 53 is put to penetrate the through hole 52*b* of the ceiling plate 52 so as to fit the vanes 53*a* into the rotor chamber 52*a*. Then, the ceiling plate 52 is positioned at a given location on the substrate 51 to bond them together as in the first embodiment. Subsequently, a lubricant, such as grease, that dually serves as a sealant, is injected between the through hole 52*b* of the ceiling plate 52 and the spindle 54 of the rotor 53. Then, liquid is filled in from the liquid supply port 52*c* provided for the ceiling plate 52 to the rotor chamber 52*a*, and the liquid supply port 52*c* is sealed.

Each of the heat generating units 51*a* on the substrate 51 is energized at one time or one after another, thus causing liquid, which is in contact with each one of them, to be heated and foamed. Then, by means of the pressure exerted by expanded bubbles, the rotor 53 rotates to drive the spindle 54 to rotate as in the third embodiment. In this way, a rotating element (not shown) coupled to the spindle can rotate at a revolution of several tens of rpm to as high as several thousands of rpm.

A part of liquid flows in between the through hole 52*b* of the ceiling plate 52 and the spindle 54. As a result, the spindle 54 is axially supported by the static pressure thus exerted. Therefore, it is possible to perform the rotation of the spindle in a high precision whose deviation is less than 0.5 $\mu$m.

Figure 16:
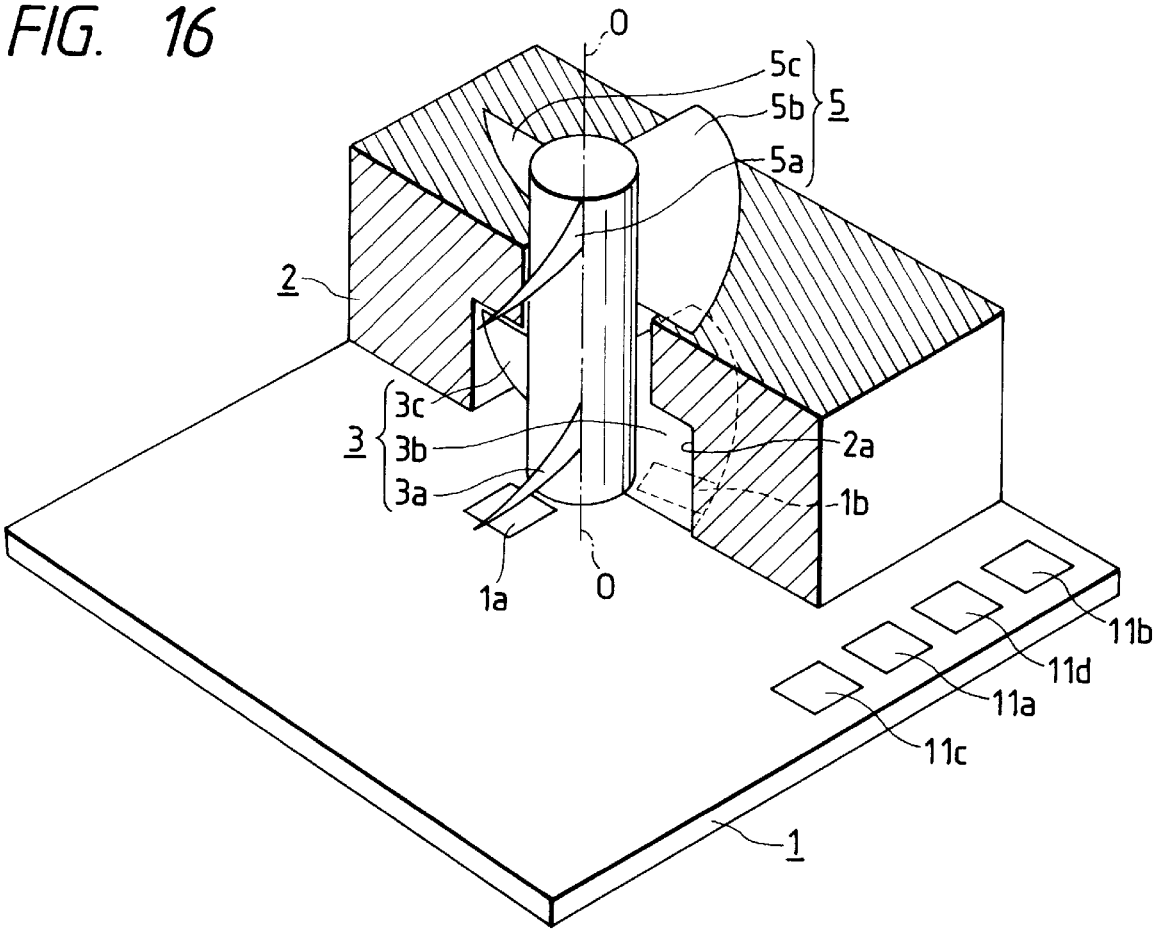
FIG. 16 is a partly broken perspective view which shows a micropump in a partly broken state in accordance with still another embodiment of the present invention.
Figure 17:
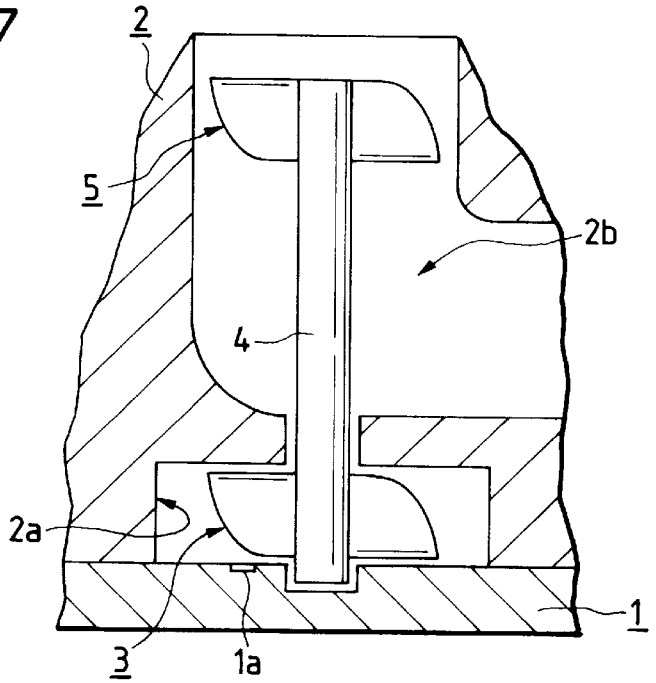
FIG. 17 is a cross-sectional view schematically showing the principal part of an apparatus in accordance with still another embodiment of the present invention.

FIG. 16 is a perspective view which shows a micropump in a partly broken state in accordance with still another embodiment of the present invention. The micropump comprises a substrate 1 having three heat generating units 1*a* to 1*c* (heat generating unit 1*c* is not shown) arranged around a given axis 0 at equal intervals; a ceiling plate 2 bonded on the surface thereof to serve as means for liquid retaining means; and a first rotator 3 fitted rotatively into a cylindrical motor chamber 2*a* formed at the bottom of the ceiling plate 2 to serve as a liquid retaining portion. In FIG. 16, the upper part of the ceiling plate 2 and the side portion on the left-hand side in FIG. 16 are shown in a state of being broken away. As shown in FIG. 17, a liquid chamber 2 is arranged in the upper part of the ceiling plate 2. The upper end of the liquid chamber 2 is open to a piping (not shown) that penetrates the ceiling plate 2 upward in FIG. 17. The first rotator 3 is coupled to a second rotator 5 integrally through a spindle 4. The second rotator 5 is arranged in the liquid chamber 2*b*, and by the rotation of the second rotator 5, liquid in the liquid chamber 2*b* is agitated or supplied and exhausted.

Each of the heat generating units 1*a* to 1*c* on the substrate 1 is connected with each of the separated terminals 11*a* to 11*c* and a common terminal 11*d* exposed at the edge of the substrate 1, and energized through them one after another or at one time at a given timing to generate heat, thus heating liquid in the motor chamber 2 to cause it to boil.

The first rotator 3 is provided with the same number, that is, three vanes 3*a* to 3*c*, as the heat generating units 1*a* to 1*c* on the substrate. These vanes receive the expansive pressure of bubbles created by the head generated by each of the heat generating elements 1*a* to 1*c* to cause the first rotator 3 to rotate. By the rotation thereof, the second rotator 5 is driven to rotate, thus effectuating the pumping action for supplying, exhausting, or agitating liquid in the liquid chamber 2.

The micropump of the present embodiment is to compulsorily circulate or agitate ink serving as a recording liquid of the liquid jet recording head. The inner structure of the substrate 1 is as already described in conjunction with FIG. 2.

Figure 18:
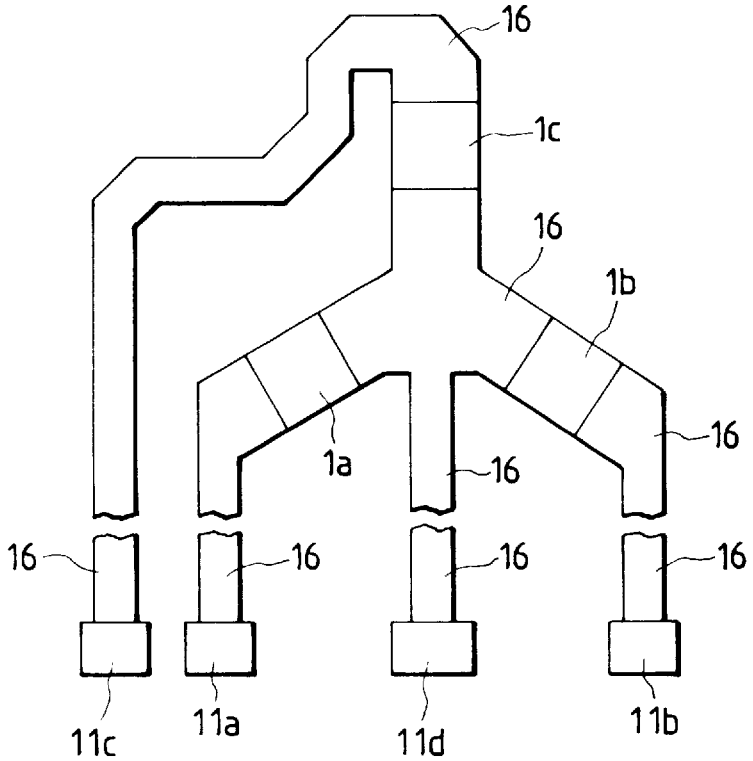
FIG. 18 is an upper surface view which shows the wiring connected with the heat generating units of an apparatus in accordance with still another embodiment of the present invention.

The separated terminals 11*a* to 11*c* and the common terminal 11*d* of each of the heat generating units 1*a* to 1*c* are arranged on the end portion of the Al wiring layer 16 patterned as shown in FIG. 18.

In this respect, a silicon substrate is used for the main body of the substrate 1 of the present embodiment, but it may be possible to use a glass plate or ceramic plate, such as $Al_2O_3$ instead of the silicon substrate.

Figure 19:
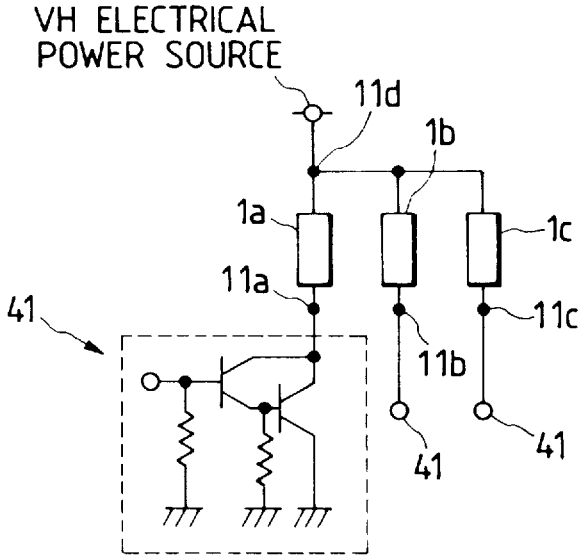
FIG. 19 is a circuit diagram which shows the electric circuit of the heat generating unit of an apparatus in accordance with still another embodiment of the present invention.

The size of each of the heat generating units 1*a* to 1*c* is 200 $\mu$m wide and 300 $\mu$m long. The sheet resistance of the heat generating element 15 is 21 Ω/□, and the resistive value is 31.5 Ω. Now, if the common terminal 11*d* is connected to the power-supply VH of an applied voltage 30V, and each of the separated terminals 11*a* to 11*c* is connected to a transistor 41 having its On time of 20 82 second as shown in FIG. 19, it is possible to obtain a sufficient energy to cause liquid (ink) in the motor chamber 2 to be foamed.

Each of the vanes 3*a* to 3*c* of the first rotator 3 is arranged around the shaft of the first rotator 3 at equal intervals, and is of the configuration that an extremely thin plate is wound spirally around the shaft in order to transform the expansive pressure exerted by means of bubbles created by the boiling of liquid on each of the heat generating units 1*a* to 1*c* on the substrate 1 into the rotational torque easily.

Also, the second rotator 5, which presents an integral body together with the first rotator 3, is provided with three vanes 5*a* to 5*c*, and each of them is in the same configuration as that of each of the vanes 3*a* to 3*c* of the first rotator 3.

For the material of the rotational body comprising the first rotator 3, the spindle 4, and the second rotator 5, it is preferable to adopt a plastic material having a small specific gravity, that can be integrally formed by means of an injection molding or the like easily, such as polypropylene, polyethylene, polysulfone, or polyethersulfone.

The dimensions of the first rotator are defined to be: the maximum outer diameter is 2 mm; the diameter of the shaft is 0.5 mm; the thickness of each of the vanes 3*a* to 3*c* is 0.2 mm; and the length of the shaft is 0.4 mm. The dimensions of the second rotator are also the same as the above.

If, for example, liquid in the liquid chamber 2*b* is ink whose main component is water, and viscosity is approximately 4 to 5 cp, it is possible to pump up the liquid in the liquid chamber 2*b* at approximately 0.1 to 5 cc/min. by the pumping function of the second rotator 5.

Also, since the liquid foaming is the driving source, the rising and falling of the pumping action is extremely rapid. Therefore, it is preferably usable for pumping up liquid intermittently at specific intervals and for agitating it.

Further, since the pumping action is stable, it is possible to pump up liquid at a given flow rate regularly.

In addition, it is easy to manufacture each rotator, while no expensive material is needed. As a result, the costs of parts are low, making it possible to materialize an extremely small and inexpensive micromachine.

Figure 20:
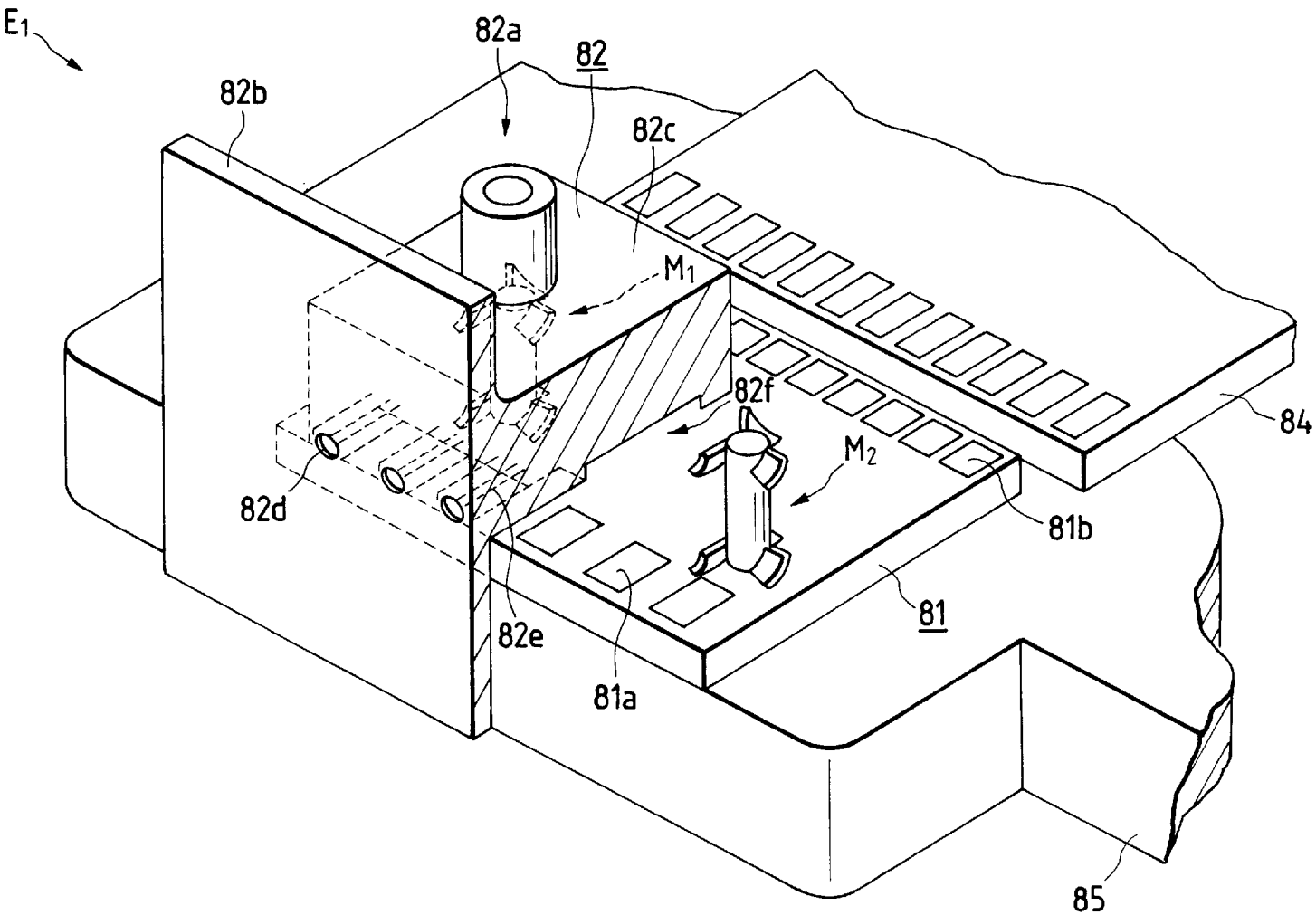
FIG. 20 is a partly broken perspective view which shows the principal part of a liquid jet recording head in a partly broken state, which uses a micropump in accordance with still another embodiment of the present invention.

FIG. 20 is a partly perspective view which shows the principal part of the liquid jet recording head $E_1$ that uses a pair of micropumps $M_1$ and $M_2$ structured the same as those micropumps in accordance with the present embodiment. This head comprises a substrate 81 whose inner structure is the same as that of the substrate 1 described above; and a ceiling plate 82, which is means for constituting plastic liquid paths, and pressed to the surface of the substrate by means of an elastic member to be described later. The substrate 81 is provided with heat generating units 81*a* for use of droplet discharge arranged near the end portion thereof, and a pair of second heat generating units (not shown) arranged on the central portion thereof. On the other end of the substrate 81, the separated terminals 81*b* and a common terminal (not shown) are exposed to energize the heat generating units 81*a* for use of liquid discharge and heat generating units for use of the micropumps by a given timing, respectively.

The ceiling plate 82 is provided with an orifice plate member 82*b* having a pair of tubular extrusions 82*a* (one of them is not shown), and orifices arranged on a line. For the main body 82*c* of the ceiling plate 82, there are formed liquid paths (nozzles) 82*e* conductively connected with each of the orifices 82*d* of the orifice plate member 82*b,* and a common liquid chamber 82*f.* In the common liquid chamber 82*f,* micropumps $M_1$ and $M_2$ are arranged. Each of them is provided with a first rotator and a second rotator, respectively, as the rotators 3 and 5 described earlier.

Each of the orifices 82*d* of the orifice plate member 82*b* of the ceiling plate 82 is arranged over approximately 4.5 mm at equal intervals in a high density of approximately 360 dpi (dots per inch), for example.

The inner structure of the heat generating units 81*a* for use of droplet discharge and that of the heat generating units for use of micropumps on the substrate 81 are the same with the exception of the areas thereof. As a result, it is possible to produce them by one and the same process. In this respect, the dimension of each heat generating unit for use of micropumps is $105\times40\ \mu m^2$, while the area of each heat generating unit 81*a* for use of droplet discharge is extremely fine so as to materialize the dot numbers described above.

The ceiling plate 82 is integrally formed by an injection molding in the same way as the ceiling plate 1 for the first embodiment. Then, on the surface of the orifice plate member 82*b,* a water repellent film (Saitop CTX manufactured by Asahi Glass) is coated. If any improvement of adhesion is needed, it should be effective to coat an adhesion enhancement agent (Sealant coupling agent A1110 manufactured by Nihon Unika) before coating any water repellent agent.

In this respect, the substrate 81 is supported to a heat radiating plate 85 together with a printed circuit board 84 having a driving circuit (not shown) on it to drive the heat generating units 81*a* for use of droplet discharge and the heat generating units for use of micropumps.

Ink serving as a recording liquid is sucked into the common liquid chamber 82*f* by means of the micropump $M_1$ on the ink supply side, and exhausted by means of the micropump $M_2$ on the ink exhaust side.

The ink that flows in each of the liquid paths 82*e* from the common liquid chamber 82*f* is heated and foamed by the heat generating units 81*a* for use of droplet discharge, which generate heat selectively by means of the driving circuit described above, thus being discharged as flying droplets from the orifices 82*d* of the orifice plate member 82*b* to adhere to a recording sheet or the like (not shown) for printing.

Further, by temporarily suspending the micropump $M_2$ on the exhaust side or reducing its speed, it is possible to increase the pressure exerted on ink in the common liquid chamber 82*f,* thus pushing out ink from each of the liquid paths 82*e* by force to remove adhesive particles in each liquid path 82*e* for the recovery of the droplet discharge performance. In accordance with the conventional technique, the recovery of the droplet discharge performance is carried out by a pump separately prepared. With the present embodiment, however, it is possible to use a micropump incorporated in the liquid jet recording head. Therefore, the assembling process and the maintenance can be simplified significantly.

Figure 21:
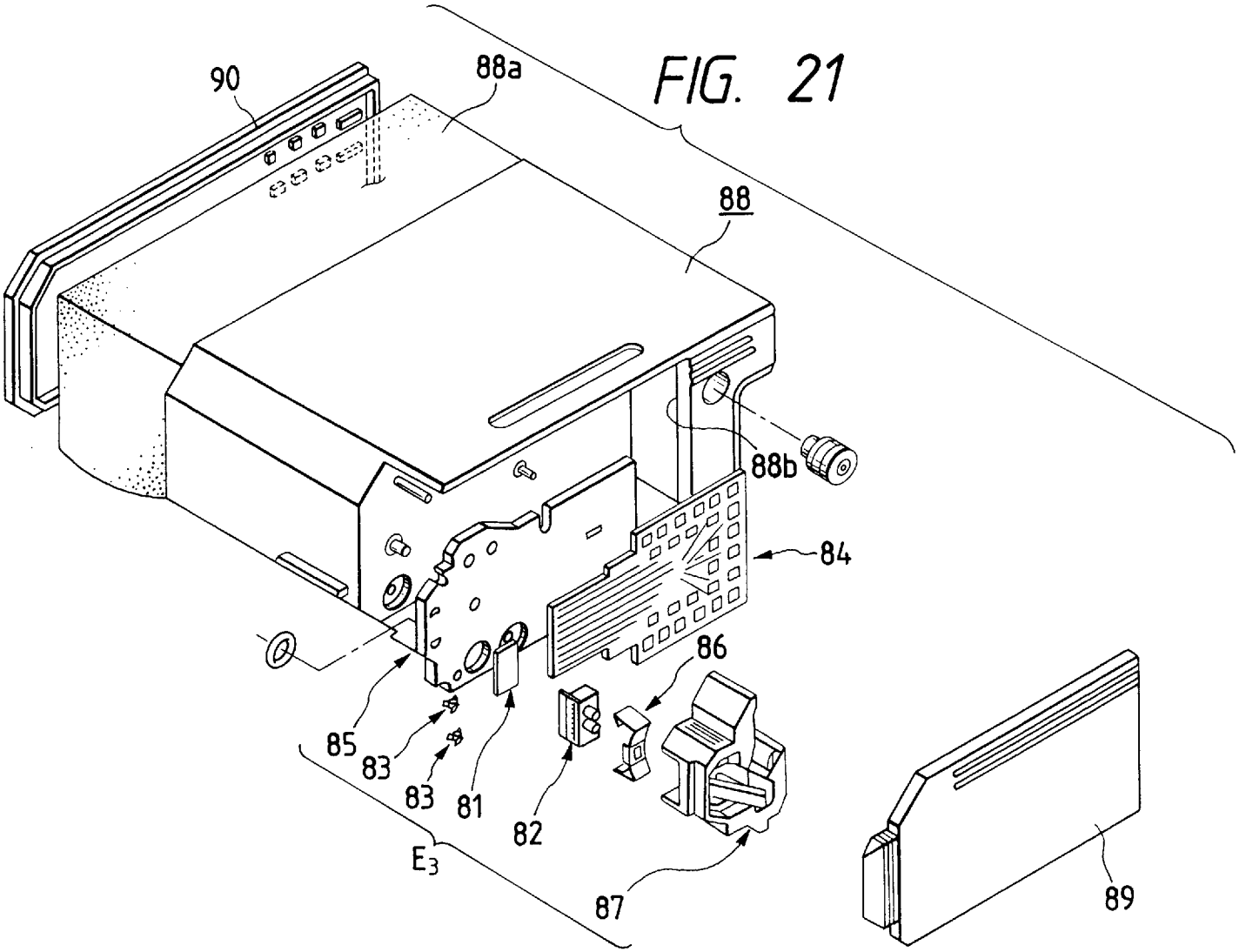
FIG. 21 is a partly broken perspective view which shows the liquid jet recording head cartridge in an exploded state, which uses a liquid jet recording head in accordance with each of the embodiments of the present invention.
Figure 22:
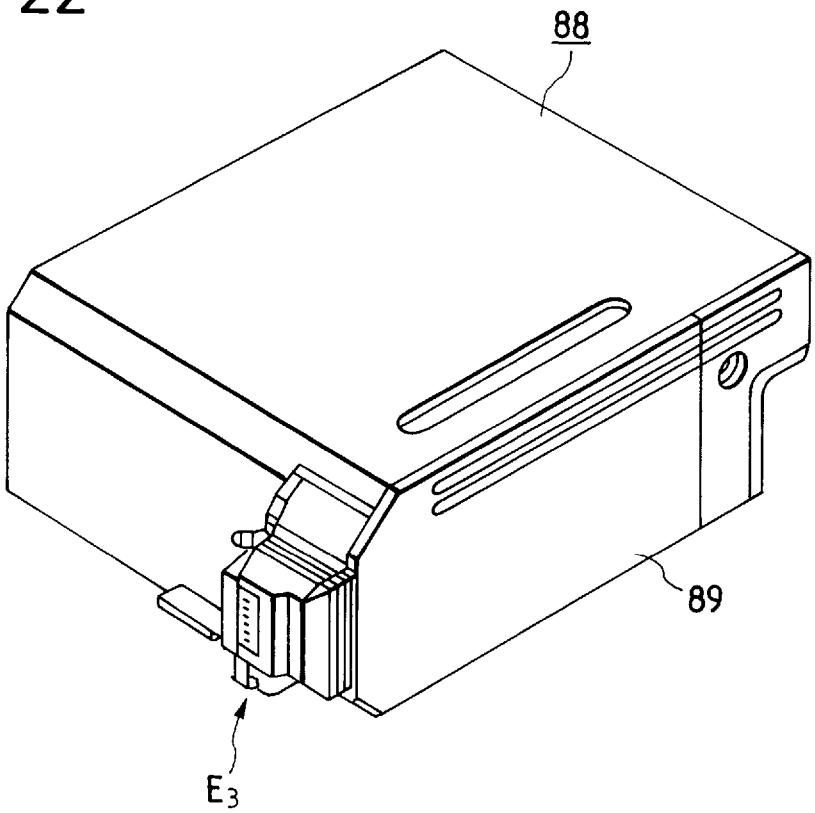
FIG. 22 is a perspective view which shows the liquid jet recording head cartridge in an assembled state, which uses a liquid jet recording head in accordance with each of the embodiments of the present invention.

FIGS. 21 and 22 are views which illustrate the assembling of a liquid jet recording head cartridge as a whole, which mounts a liquid jet recording head $E_3$ in accordance with each of the embodiments described above. At first, a ceiling plate 82 is pressed by an elastic member 86 to a substrate 81, and after the plate and board are integrated, the substrate 81 and a printed circuit board 84 are fixed to a heat radiation plate 85 by means of screws. An ink supply member 87 having a supply tube and an exhaust tube, which are fitted to each of the extrusions 82*a* of the ceiling plate 82, is assembled on the ceiling plate 82.

The plate thus assembled is positioned at the recess 88*b* of an ink tank 88 having a sponge 88*a* to soak ink in it. The side plate 89 is fixed to the ink tank 88 by means of screws. The opposite side is closed by a cover 90. Here, if necessary, a silicone sealant TES-399 (manufactured by Toshiba Silicone) or the like or a urethane or an epoxy sealant is injected in order to prevent any ink leakage from each part, and also, to protect such part after the ink supply member 87 is assembled on the ceiling plate 82.

Figure 23:
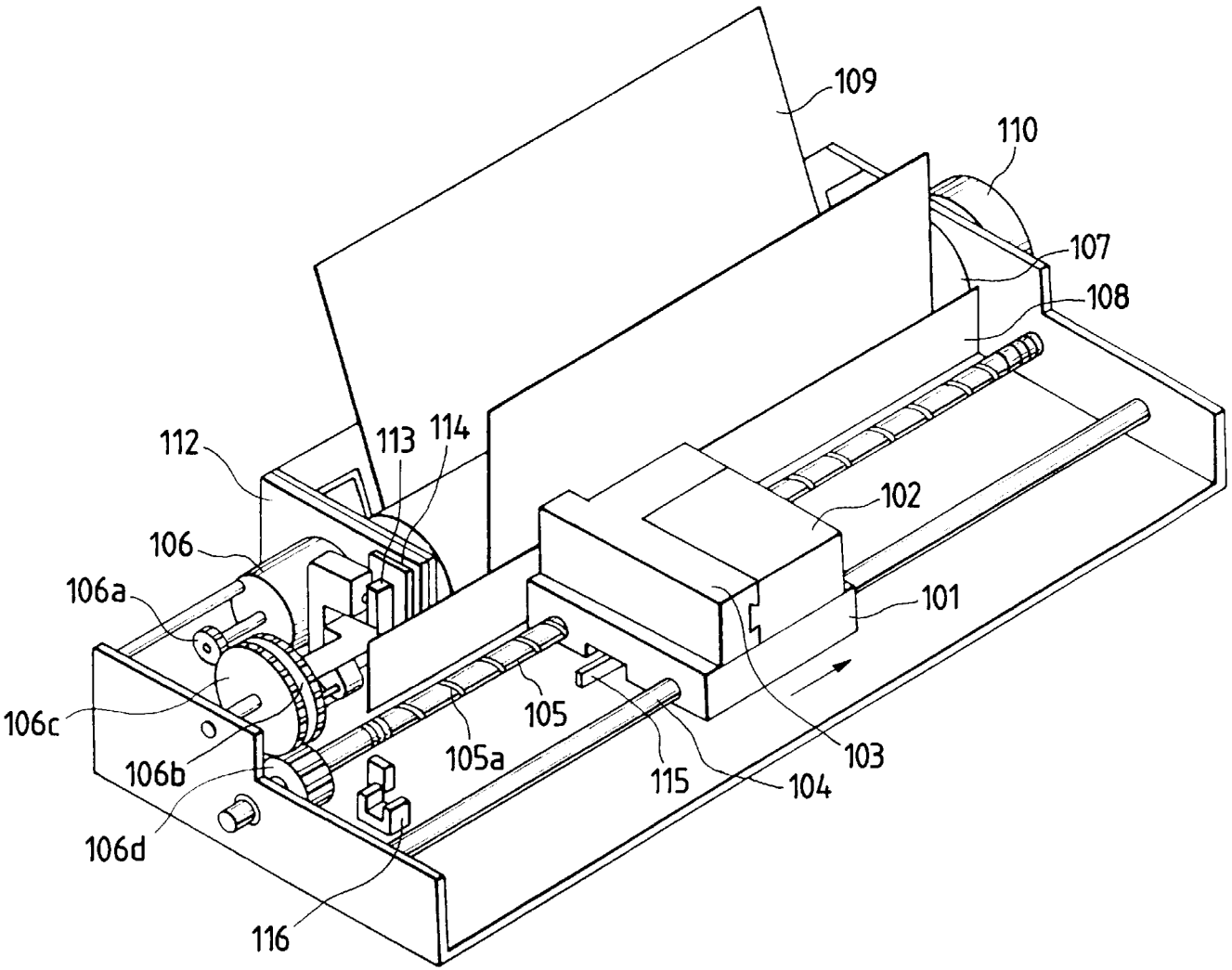
FIG. 23 is a perspective view which shows a liquid jet recording apparatus as a whole.

Now, with reference to FIG. 23, the description will be made of a liquid jet recording apparatus having a liquid jet recording head of the present invention mounted on it.

A recording head cartridge is provided with a liquid jet recording head (hereinafter referred to as a recording head) 103 and an ink container serving as an ink tank, which are coupled to each other. A carriage 101 having the recording head cartridge mounted thereon is guided by a guide shaft 104 and a lead screw 105 provided with a spiral groove 105*a.* On the carriage 101, it is possible to mount an ink container cassette 102 having an ink container incorporated in it.

The lead screw 105 can rotate regularly and reversely by means of a reversible driving motor 106 through a train of gears 106*a,* 106*b,* 106*c,* and 106*d,* thus reciprocating the carriage 101 in the direction indicated by an arrow and the direction opposite to it through a pin (not shown) provided for the carriage 101, the leading end of which engages with the spiral groove 105*a* of the lead screw. The switching over of the regular and reverse rotations of the driving motor 106 is carried out by means of the lever 115 and photocoupler 116 provided for the carriage 101, which detect whether or not the carriage 101 is at its home position.

Meanwhile, a recording sheet 109 serving as a recording medium is pressed to a platen 107 by means of a pressure plate 108. Then, it is carried by a sheet feed roller (not shown) driven by a sheet feed motor 110, which functions as a feeding device to carry and enable the recording medium to face the recording head 103.

Figure 24:
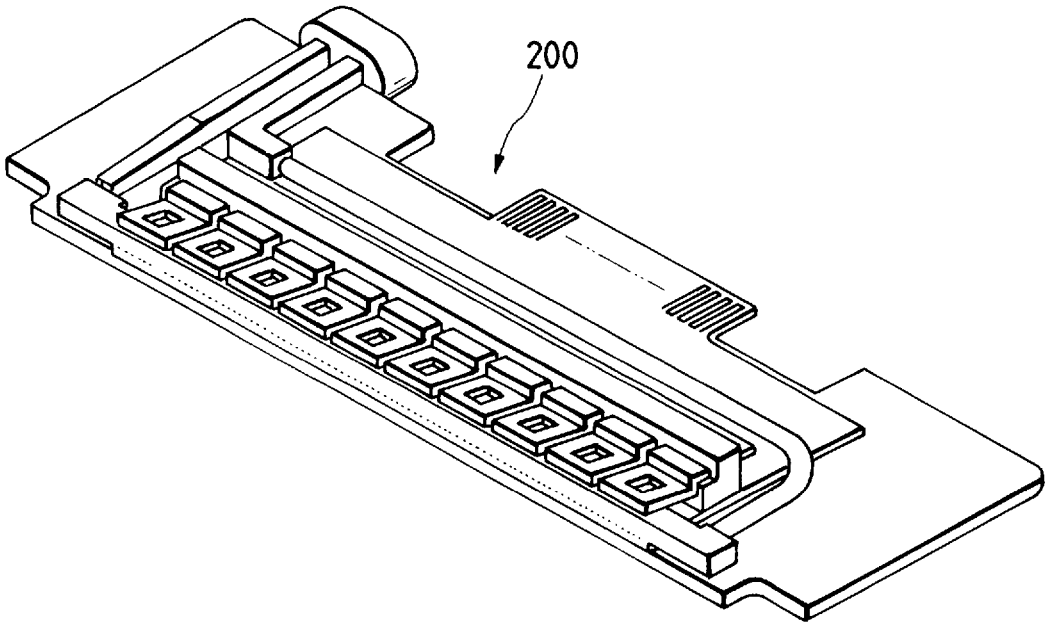
FIG. 24 is a perspective view which schematically shows a full line type liquid jet recording head.
Figure 25:
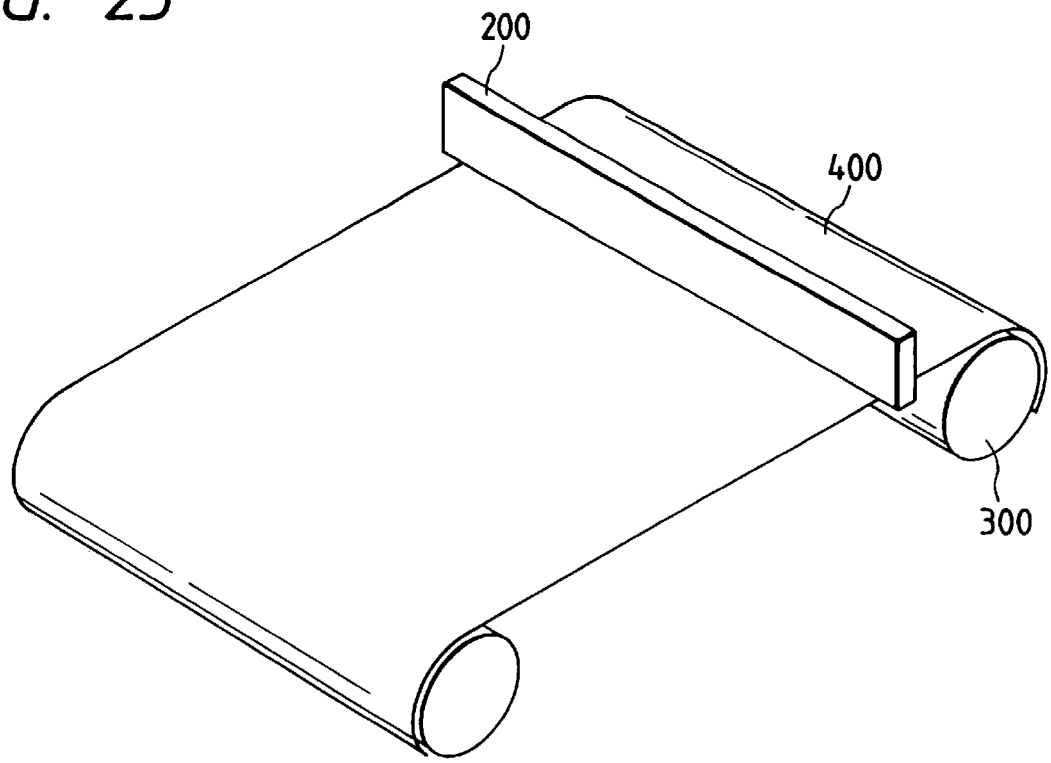
FIG. 25 is a perspective view which schematically shows a liquid jet recording apparatus having a liquid jet recording head mounted on it.
Figure 26:
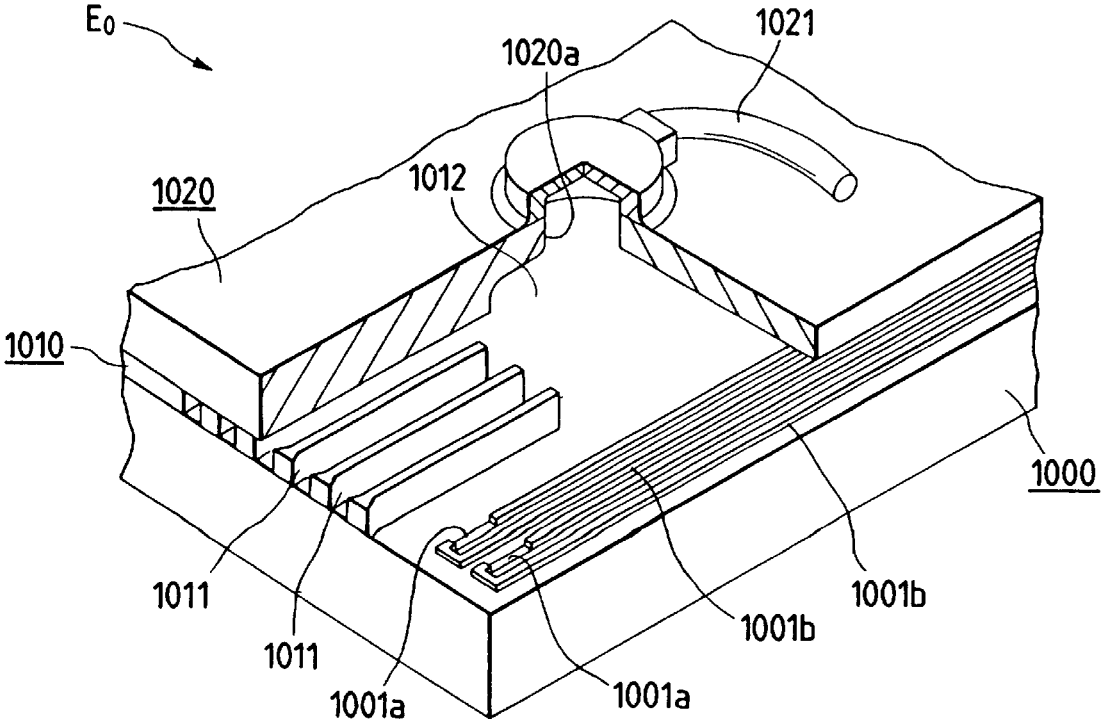
FIG. 26 PRIOR ART
FIG. 26 is a partly broken perspective view which shows the principal part of a liquid jet recording head in a partly broken state in accordance with a conventional example.

FIGS. 24 and 25 are perspective views which schematically illustrate the so-called full line type ink jet recording head having a width corresponding to the recordable width of a recording medium, and an ink jet recording apparatus using such ink jet recording head; that is, these views illustrate the entire body of another liquid jet recording head having a liquid jet recording head mounted in accordance with each of the embodiments described above.

The full line type ink jet recording head is provided with many numbers of discharge ports to serve its purpose. Here, the present invention is able to demonstrate its effects most conspicuously.

For a recording apparatus of the kind, a full line ink jet recording head 200 is arranged to face a paper sheet, cloth, or other recording media 400, which is carried by means of a feed roller 300. Then, while a recording medium is being carried, ink is discharged from the full line type ink jet recording head 200 onto the recording medium in accordance with recording signals. In this way, recording is performed on an elongated recording medium. In case of the present invention, ink jet recording heads are manufactured by arranging a plurality of heater boards provided with discharge energy generating elements. Therefore, it is easy to manufacture an elongated ink jet recording head, such as a full line recording head described above.

Of the liquid jet recording methods, the present invention demonstrates particularly excellent effects when it is applied to a recording head and recording apparatus using the so-called ink jet recording method whereby to form flying droplets for recording by the utilization of thermal energy.

Regarding the typical structure and operational principle of such method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well.

Now, to describe this recording method briefly, discharge signals are supplied from the driving circuit that serves as driving means for generating heat by supplying electric signals to electrothermal transducing elements, which are the heat generating units arranged to face a sheet or ink paths retaining a recording liquid (ink) thereon. In other words, at least one driving signal, which provides a rapid temperature rise beyond a departure from nucleation boiling point in response to recording information, is made applicable to an electrothermal transducing element disposed on a liquid (ink) retaining sheet or liquid path whereby to cause the electrothermal transducing element to generate thermal energy to produce film boiling on the thermoactive portion of the recording head, thus effectively leading to the resultant formation of a bubble in the recording liquid (ink) one to one in response to each of the driving signals. Therefore, this is particularly effective with respect to the recording method of on-demand type. By the development and contraction of the bubble, the liquid (ink) is discharged through a discharge port to produce at least one droplet. The driving signal is more preferably in the form of pulses because the development and contraction of the bubble can be effectuated instantaneously, and, therefore, the liquid (ink) is discharged with quicker response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid paths, and the electrothermal transducing elements (linear type liquid paths or right-angled liquid paths). Besides, the present invention is effective with respect to the structure such as disclosed in the specifications of U.S. Pat. Nos. 4,558,333 and 4,459,600 wherein the thermal activation portions are arranged in a curved area.

In addition, the present invention is effectively applicable to the structure disclosed in Japanese Patent Application Laid-Open No. 59-123670 wherein a common slit is used as the discharging ports for plural electrothermal transducers, and to the structure disclosed in Japanese Patent Application Laid-Open No. 59-138461 wherein an aperture for absorbing pressure wave of the thermal energy is formed corresponding to the discharge ports.

Further, the present invention is effectively applicable to a recording head of full-line type having a length corresponding to the maximum width of a recording medium recordable by the recording apparatus. For the full line head, it may be possible to adopt either a structure whereby to satisfy the required full line arrangement by combining a plurality of recording heads or a structure arranged by one recording head integrally formed.

In addition, the present invention is effectively applicable to the recording head of an exchangeable chip type, which can be electrically connected with the apparatus main body or to which ink can be supplied from the apparatus main body when it is mounted on the apparatus main body, or using the recording head of a cartridge type in which an ink tank is formed integrally with the recording head itself.

Further, the present invention is extremely effective in applying it not only to a recording mode in which only main color such as black is used, but also to an apparatus having at least one of multi-color modes with ink of different colors, or a full-color mode using the mixture of the colors, irrespective of whether the recording heads are integrally structured or structured by a combination of plural recording heads.

In accordance with the present invention, the most effective method for the various kinds of ink described above is the method in which film boiling is effectuated as described earlier.

Further, as the mode of the ink jet recording apparatus of the present invention, it may be possible to adopt a copying apparatus combined with a reader in addition to the image output terminal for a computer or other information processing apparatuses, and also, it may be possible to adopt a mode of a facsimile equipment having transmitting and receiving functions.

What is claimed is:

1. A micromachine comprising:

at least one heat generating unit arranged on a surface of a substrate;

means for retaining liquid having a liquid retaining portion surroundind said at least one heat generating unit; and a rotator rotatively supported in said liquid retaining portion of said means for retaining liquid, wherein said rotator comprises means for rotating said rotator by the liquid when boiled in said liquid retaining portion by heat generated by said at least one heat generating unit.

2. A micromachine according to claim 1, wherein said micromachine comprises a micropump and causes the liquid to flow compulsorily.

3. A micromachine according to claim 1, further comprising a shaft member integrally formed with said rotator.

4. A micromachine according to claim 1, wherein said rotator is integrally formed by an injection molding of plastic material.

5. A micromachine according to claim 1, wherein said rotator is manufactured by a laser processing of a blank obtained by an injection molding of plastic material.

6. A micromachine according to claim 1, wherein a plurality of said heat generating units are arranged on the surface of the substrate, and said rotator comprises a plurality of vanes for transforming boiling pressure of the liquid in said liquid retaining portion exerted by the heat generated by said heat generating units into rotational torque, and a number of said vanes and a number of said heat generating units are in a prime relationship.

7. A micromachine according to claim 6, wherein each vane of said rotator is mounted at an angle of less than 30°.

8. A micromachine according to claim 1, wherein said rotator is provided with a first rotator section and a second rotator section integrally formed with said first rotator section, and said second rotator section is driven to rotate by rotation of said first rotator section by boiling of the liquid in said liquid retaining portion by the heat generated by said heat generating units in order to cause the liquid on a circumference thereof to flow.

9. A liquid jet recording head comprising:

a substrate having a plurality of first heat generating units for use in droplet discharge;

means for constituting liquid paths having a common liquid chamber conductively connected with each of said liquid paths along each of said heat generating units on said substrate; and at least one micropump communicating with said common liquid chamber and causing recording liquid in said common liquid chamber of said means for constituting liquid paths to flow compulsorily, wherein said at least one micropump comprises at least one second heat generating unit at a predetermined location on said substrate, and at least one rotator being rotated by boiling of the recording liquid by heat generated by said at least one second heat generating unit.

10. A liquid jet recording head according to claim 9, wherein said at least one micropump comprises first and second micropumps, and said first micropump supplies the recording liquid to the common liquid chamber, and said second micropump exhausts the recording liquid.

11. A liquid jet recording head according to claim 9, wherein said at least one micropump comprises a plurality of said second heat generating units, and said rotator comprises a plurality of vanes transforming boiling pressure of the recording liquid exerted by heat generated by said plurality of second heat generating units, and a number of said vanes of said rotator and a number of said plurality of second heat generating units are in a prime relationship.

12. A liquid jet recording head according to claim 9, wherein said at least one micropump comprises a plurality of second heat generating units and first and second rotators, said first rotator rotating by the boiling of the recording liquid by heat generated by said second heat generating units, and said second rotator being driven to rotate by rotation of said first rotator.

13. A liquid jet recording apparatus comprising:

a liquid jet recording head comprising a substrate having a plurality of first heat generating units for use in droplet discharge;

means for constituting liquid paths having a common liquid chamber conductively connected with each of the liquid paths along each of said first heat generating units on said substrate; and at least one micropump communicating with said common liquid chamber and causing recording liquid in said common liquid chamber of said means for constituting liquid paths to flow compulsorily, said at least one micropump comprising a least one second heat generating unit at a predetermined location on said substrate, and a rotator being rotated by boiling of the recording liquid by heat generated by said at least one second heat generating unit;

driving means for supplying electric signals to said first heat generating units of said liquid jet recording head for generating heat; and a mechanism carrying a recording medium to cause the recording medium to face said liquid jet recording head.

* * * * *

UNITED STATES PATENT AND TRADEMARK OFFICE

CERTIFICATE OF CORRECTION

PATENT NO. : 5,815,181 Page 1 of 2

DATED : September 29, 1998

INVENTOR(S) : KASHINO ET AL.

It is certified that error appears in the above-indentified patent and that said Letters Patent is hereby corrected as shown below:

On the title page;

[54] IN THE TITLE:

Line 5, "HEADMOUNTED" should read --HEAD MOUNTED--.

COLUMN 1:

Line 5, "HEADMOUNTED" should read --HEAD MOUNTED--.
Line 19, "a" should be deleted.
Line 52, "the" should read --this--.

COLUMN 2:

Line 37, "should" should read --could--.
Line 45, "objects" should read --object--.

COLUMN 3:

Line 27, "costs." should read --cost.--.
Line 34, "each" should read --affecting each--.

COLUMN 4:

Line 22, "cross-suctional" should read --cross-sectional--.

UNITED STATES PATENT AND TRADEMARK OFFICE

CERTIFICATE OF CORRECTION

PATENT NO. : 5,815,181 Page 2 of 2

DATED : September 29, 1998

INVENTOR(S) : KASHINO ET AL.

It is certified that error appears in the above-indentified patent and that said Letters Patent is hereby corrected as shown below:

COLUMN 11:

Line 2, "31 spirally" should read --31--.

COLUMN 13:

Line 37, "liquid" should read --the liquid--.

COLUMN 18:

Line 61, "surroundind" should read --surrounding--.

COLUMN 20:

Line 34, "a" should read --at--.

Signed and Sealed this

Twenty-first Day of September, 1999

*Attest:*

Q. TODD DICKINSON

*Attesting Officer*

*Acting Commissioner of Patents and Trademarks*